US011731126B2

(12) United States Patent
Li et al.

(10) Patent No.: US 11,731,126 B2
(45) Date of Patent: Aug. 22, 2023

(54) MICROFLUIDIC BOARD AND METHOD OF FORMING THE SAME

(71) Applicant: NANYANG TECHNOLOGICAL UNIVERSITY, Singapore (SG)

(72) Inventors: Tao Li, Singapore (SG); Pooi See Lee, Singapore (SG)

(73) Assignee: NANYANG TECHNOLOGICAL UNIVERSITY, Singapore (SG)

( * ) Notice: Subject to any disclaimer, the term of this patent is extended or adjusted under 35 U.S.C. 154(b) by 190 days.

(21) Appl. No.: 17/048,997

(22) PCT Filed: Mar. 21, 2019

(86) PCT No.: PCT/SG2019/050155
§ 371 (c)(1),
(2) Date: Oct. 19, 2020

(87) PCT Pub. No.: WO2019/203727
PCT Pub. Date: Oct. 24, 2019

(65) Prior Publication Data

US 2021/0237057 A1 Aug. 5, 2021

(30) Foreign Application Priority Data

Apr. 19, 2018 (SG) ..... 10201803300T

(51) Int. Cl.
*B01L 3/00* (2006.01)

(52) U.S. Cl.
CPC ..... *B01L 3/502707* (2013.01); *B01L 3/5025* (2013.01); *B01L 2200/10* (2013.01);
(Continued)

(58) Field of Classification Search
CPC ..... B01L 3/5025; B01L 2200/10; B01L 2300/0819
See application file for complete search history.

(56) References Cited

U.S. PATENT DOCUMENTS 6,494,614 B1 12/2002 Bennett et al.
8,573,259 B2 11/2013 Burns et al.
(Continued)

FOREIGN PATENT DOCUMENTS

EP 2 712 918 A1 4/2014
WO WO-2004089810 A2 * 10/2004 ..... B01L 3/00
(Continued)

OTHER PUBLICATIONS

Cicero R. de Lima et al, A biomimetic piezoelectric pump: Computational and experimental characterization, 2009, Sensors and Actuators A: Physical, 152, 110-118 (Year: 2009).*
(Continued)

*Primary Examiner* — Jennifer Wecker
*Assistant Examiner* — Mickey Huang
(74) *Attorney, Agent, or Firm* — Seed IP Law Group LLP

(57) ABSTRACT

The microfluidic board comprises a plurality of matrix units, wherein each matrix unit is a stacked arrangement comprising a driving portion comprising an actuator, a pump portion in contact with the driving portion and comprising a pump, a channel portion in contact with the pump portion and comprising one or more channels, and a chamber portion in contact with the channel portion and comprising a chamber, wherein the one or more channels are configured to direct fluid between the pump and the chamber, and wherein the actuator is configured to generate a force to drive the pump upon receiving of an input energy.

20 Claims, 17 Drawing Sheets

(52) U.S. Cl.
CPC ..... *B01L 2300/0819* (2013.01); *B01L 2300/0874* (2013.01); *B01L 2400/0487* (2013.01)

(56) References Cited

U.S. PATENT DOCUMENTS

| | | | | |
|---|---|---|---|---|
| 2002/0185184 | A1 | 12/2002 | O'Connor et al. | |
| 2004/0063217 | A1 | 4/2004 | Webster et al. | |
| 2005/0255007 | A1 | 11/2005 | Yamada et al. | |
| 2007/0166199 | A1 | 7/2007 | Zhou et al. | |
| 2014/0186846 | A1 | 7/2014 | Tanaka et al. | |
| 2014/0322099 | A1* | 10/2014 | Zhou | F16K 99/0015 422/502 |
| 2016/0220997 | A1 | 8/2016 | Mescher et al. | |

FOREIGN PATENT DOCUMENTS

| | | | |
|---|---|---|---|
| WO | 2008/115626 | A2 | 9/2008 |
| WO | 2012/024657 | A1 | 2/2012 |
| WO | 2018/213357 | A1 | 11/2018 |

OTHER PUBLICATIONS

Vollertsen et al., "Modular operation of microfluidic chips for highly parallelized cell culture and liquid dosing via a fluidic circuit board", Microsystems & Nanoengineering, (2020)6:107 (Year: 2020).*
Shaikh et al., "A modular microfluidic architecture for integrated biochemical analysis," *PNAS* 102(28):9745-9750, 2005.
Extended European Search Report, dated Dec. 13, 2021, for European Application No. 19789273.0-1101, 8 pages.

* cited by examiner

MICROFLUIDIC BOARD AND METHOD OF FORMING THE SAME

CROSS-REFERENCE TO RELATED APPLICATION

This application claims the benefit of priority of Singapore application No. 10201803300T filed Apr. 19, 2018 the contents of it being hereby incorporated by reference in its entirety for all purposes.

TECHNICAL FIELD

Various aspects of this disclosure relate to a microfluidic board. Various aspects of this disclosure relate to a method of forming a microfluidic board.

BACKGROUND

A quick, on-site detection of the infectious diseases is desirable for patients as "point-of-care", "test and treat" becomes possible, which saves diagnostic time and reduces the need for large and expensive resources. Accordingly, companies like Atlas Genetics Limited have developed small scale rapid diagnostic platform for decentralized laboratory applications. The cartridge may be a critical component in diagnostic devices for such applications. The diagnostic devices may integrate components, such as blisters, chambers, channels, valves, filters and reaction liquid, etc. The reaction solutions are stored in blisters, and are driven to flow along the channels by pneumatic methods. There are main channels and branch channels, intersecting and forming junctions. Gas is also introduced to clear the channel and reduce the risk of dead legs contamination. The flow directions of the liquid and gas are controlled by the valves. The test can be finished within 30 minutes. However, the structure and control of the diagnostic devices are complicated. FIG. 1 is a schematic showing an existing microfluidic board.

SUMMARY

Various embodiments may provide a microfluidic board. The microfluidic board may include a plurality of matrix units. Each matrix unit of the plurality of matrix units may be or may include a stacked arrangement. The stacked arrangement may include a driving portion including an actuator. The stacked arrangement may also include a pump portion in contact with the driving portion, the pump portion including a pump. The stacked arrangement may further include a channel portion in contact with the pump portion, the channel portion including one or more channels. The stacked arrangement may additionally include a chamber portion in contact with the channel portion, the chamber portion including a chamber. The one or more channels may be configured to direct fluid between the pump and the chamber. The actuator may be configured to generate a force to drive the pump upon receiving of an input energy.

Various embodiments may provide a method of forming a microfluidic board. The method may include forming a plurality of matrix units. Each matrix unit of the plurality of matrix units may be or may include a stacked arrangement. The stacked arrangement may include a driving portion including an actuator. The stacked arrangement may also include a pump portion in contact with the driving portion, the pump portion include a pump. The stacked arrangement may further include a channel portion in contact with the pump portion, the channel portion including one or more channels. The stacked arrangement may additionally include a chamber portion in contact with the channel portion, the chamber portion including a chamber. The one or more channels may be configured to direct fluid between the pump and the chamber. The actuator may be configured to generate a force to drive the pump upon receiving of an input energy.

BRIEF DESCRIPTION OF THE DRAWINGS

The invention will be better understood with reference to the detailed description when considered in conjunction with the non-limiting examples and the accompanying drawings, in which.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

Embodiments described in the context of one of the methods or boards are analogously valid for the other methods or boards. Similarly, embodiments described in the context of a method are analogously valid for a board, and vice versa.

The microfluidic boards as described herein may be operable in various orientations, and thus it should be understood that the terms "top", "front", "bottom", "behind" etc., when used in the following description are used for convenience and to aid understanding of relative positions or directions, and not intended to limit the orientation of the microfluidic boards.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

In the context of various embodiments, the articles "a", "an" and "the" as used with regard to a feature or element include a reference to one or more of the features or elements.

In the context of various embodiments, the term "about" or "approximately" as applied to a numeric value encompasses the exact value and a reasonable variance.

As used herein, the term "and/or" includes any and all combinations of one or more of the associated listed items.

Various embodiments may a microfluidic board which has a simpler structure. Various embodiments may be easier to design. Various embodiments may include fewer components.

The microfluidic hoard may be a matrix type or modular microfluidic board.

Figure 1:
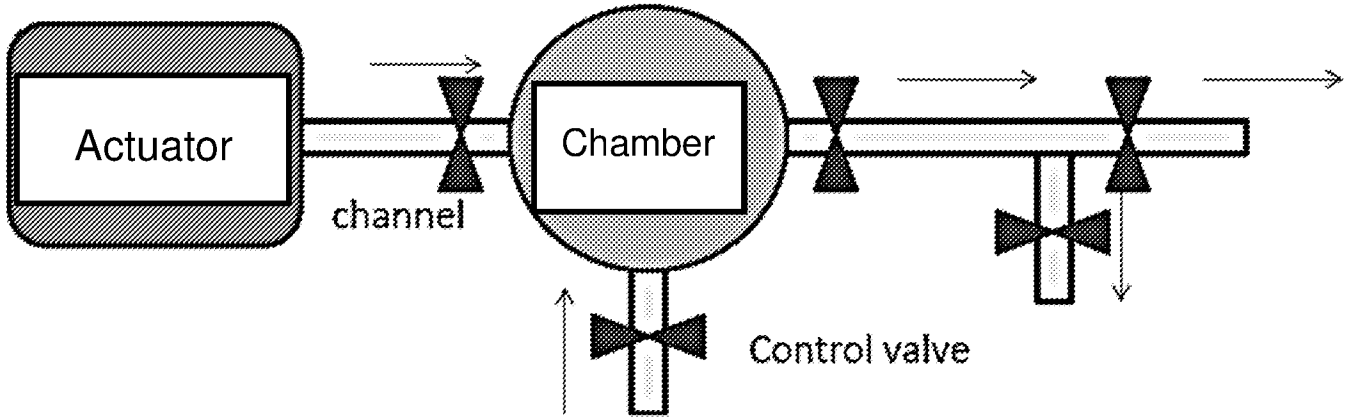
FIG. 1 is a schematic showing an existing microfluidic board.
Figure 2:
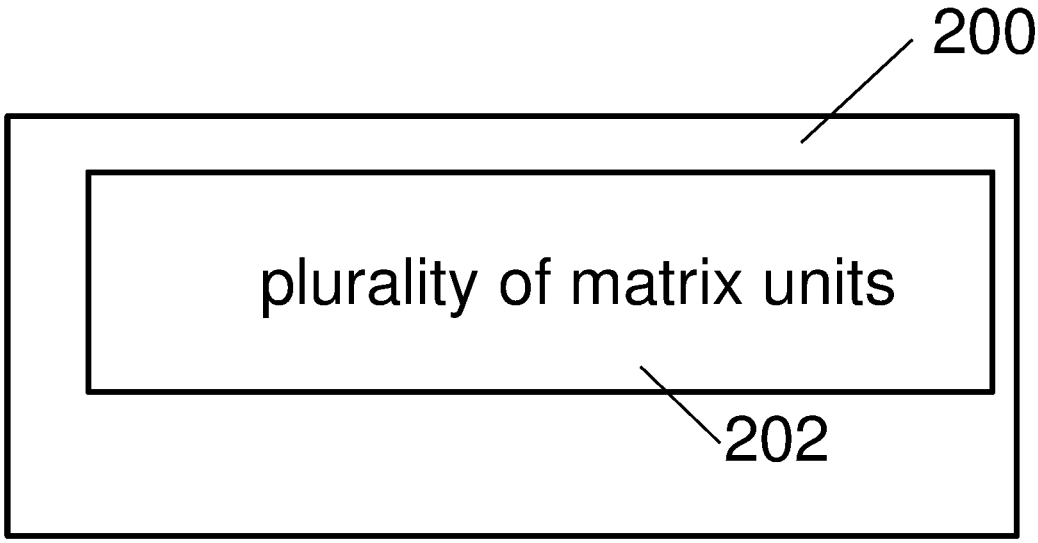
FIG. 2 is a general illustration of a microfluidic board according to various embodiments.

FIG. 2 is a general illustration of a microfluidic hoard 200 according to various embodiments. The microfluidic board may include a plurality of matrix units 202. Each matrix unit of the plurality of matrix units 202 may be a stacked arrangement. The stacked arrangement may include a driving portion including an actuator. The stacked arrangement may also include a pump portion in contact with the driving portion, the pump portion including a pump. The stacked arrangement may further include a channel portion in contact with the pump portion, the channel portion including one or more channels. The stacked arrangement may additionally include a chamber portion in contact with the channel portion, the chamber portion including a chamber. The one or more channels may be configured to direct fluid (or liquid) between the pump and the chamber. The actuator may be configured to generate a force to drive the pump upon receiving of an input energy.

In other words, the board 200 may be a modular board made up of a plurality of matrix units. Each unit may be a stacked arrangement containing a pump portion, a chamber portion, a driving portion that actuates the pump portion, and a channel portion that connects the pump portion and the chamber portion.

In various embodiments, the driving portions of the plurality of matrix units 202 may form a driving layer (or region), which may also be referred to as an actuator layer (or region) or driving actuator layer (or region). The driving layer may be a continuous layer (or region). The driving layer or region may include actuators of the driving portions of the plurality of matrix units 202. The plurality of matrix units may be arranged in a regular array or matrix having one or more rows, and one or more columns. Each unit 202 may, for instance, be of a cuboid, or a cube.

In various embodiments, the pump portions of the plurality of matrix units may form a pump layer (or region). The pump layer may be a continuous layer (or region). The pump layer or region may include pumps of the pump portions of the plurality of matrix units 202.

In various embodiments, the channel portions of the plurality of matrix units may form a channel layer (or region). The channel layer may be a continuous layer (or region). The channel layer or region may include channels of the channel portions of the plurality of matrix units 202.

In various embodiments, the chamber portion of the plurality of matrix units may form a chamber layer (or region). The chamber layer may be a continuous layer (or region). The chamber layer or region may include chambers of the chamber portions of the plurality of matrix units 202.

In various embodiments, two different layers or regions of the microfluidic board 200 may include or be made of the same materials. In various other embodiments, two different layers or regions of the microfluidic board 200 may include or be made of different materials. For instance, the pump layer or region, the channel layer or region, and the chamber layer or region may be made of polydimethylsiloxane (PDMS). In various embodiments, the different layers or regions may include PDMS, polypropylene (PP), polycarbonate (PC), polytetrafluoroethylene (PTFE), and/or acrylonitrile butadiene styrene (ABS) etc.

The microfluidic board 200 including different layers or regions may be divided or segregated or partitioned into different matrix units 202, such that each matrix unit includes a portion of each of the different layers or regions. In various embodiments, the different units may be continuous such that there may not be any dividing lines or partitions between neighboring matrix units. Each unit may be a portion of the board 200 including a stacked arrangement including a portion of the driving layer (or region), a portion of the pump layer (or region), a portion of the channel layer (or region) and a portion of the chamber layer (or region).

In various embodiments, the channel layer or region may include a base channel sub-layer or sub-region, and a jumping channel sub-layer or sub-region. The base channel sub-layer or sub-region may include a first group of channels, and the jumping channel sub-layer or sub-region may include a second group of channels different from the first group of channels. Having different sub-layers or sub-regions for different groups of channels may avoid or reduce situations in which different channels cross one another, and may lead to more flexibility in design.

In various embodiments, the actuators or actuator may be selected from a group consisting of piezoelectric actuator(s), electromagnetic actuator(s), shape memory alloy actuator(s), hydraulic actuator(s), pneumatic actuator(s), and thermal actuator(s). The actuators or actuator may be of any other suitable type of actuators. The input energy may be, for instance, electrical energy, thermal energy, or kinetic energy.

In various embodiments, at least one matrix unit of the plurality of matrix units 202 may be a delivering matrix unit. The pump of the delivering matrix unit may have a cavity with an inlet and an outlet. The inlet and outlet may be openings in the cavity. The fluid may flow into the cavity through the inlet, and may flow out of the cavity through the outlet.

A channel of the one or more channels of the delivering matrix unit may be an inlet channel connecting the chamber of the delivering matrix unit and the inlet of the pump of the delivering matrix unit. The delivering matrix unit may further include an outlet channel connected to the outlet of the pump of the delivering matrix unit. The outlet channel may be configured to direct the fluid out from the delivering matrix unit (to another part of the board or another matrix unit).

The actuator of the driving layer (or region) of the delivering matrix unit and the cavity of the pump of the delivering matrix unit may define an enclosed space so that the enclosed space is increased when the actuator moves in a first direction to direct the fluid into the cavity (of the pump of the delivering matrix unit), and the enclosed space is decreased when the actuator moves in a second direction to direct the fluid out of the cavity (of the pump of the delivering matrix unit).

The inlet of the pump of the delivering matrix unit may include a first valve configured to allow flow of the fluid to the cavity of the pump of the delivering matrix unit. The first valve may be configured to prevent the flow of the fluid from the cavity through the inlet out of the cavity. The first valve may allow flow of fluid only in one direction.

The outlet of the pump of the delivering matrix unit may include a second valve configured to allow flow of the fluid out of the cavity of the pump of the delivering matrix unit. The second valve may be configured to prevent the flow of the fluid through the outlet into the cavity. The second valve may allow flow of fluid only in one direction. The first valve and/or the second value may be passive flow control valves.

In various embodiments, at least one matrix unit of the plurality of matrix units 202 may be a receiving matrix unit. The pump of the receiving matrix unit may have a cavity with an inlet and an outlet. The inlet and outlet may be openings in the cavity. The fluid may flow into the cavity through the inlet, and may flow out of the cavity through the outlet.

A channel of the one or more channels of the receiving matrix unit may be an outlet channel connecting the chamber of the receiving matrix unit and the outlet of the pump of the receiving matrix unit.

The receiving matrix unit may further include an inlet channel connected to the inlet of the pump of the receiving matrix unit. The inlet channel may be configured to direct the fluid (from another part of the board or another matrix unit) to the receiving matrix unit.

The actuator of the driving layer (or region) of the receiving matrix unit and the cavity of the pump of the receiving matrix unit may define an enclosed space so that the enclosed space is increased when the actuator moves in a first direction to direct the fluid into the cavity (of the pump of the receiving matrix unit), and the enclosed space is decreased when the actuator moves in a second direction to direct the fluid out of the cavity the pump of the receiving matrix unit).

The inlet of the pump of the receiving matrix unit may include a first valve configured to allow flow of the fluid to the cavity of the pump of the receiving matrix unit. The first valve may be configured to prevent the flow of the fluid from the cavity through the inlet out of the cavity. The first valve may allow flow of fluid only in one direction.

The outlet of the pump of the receiving matrix unit may include a second valve configured to allow flow of the fluid out of the cavity of the pump of the receiving matrix unit. The second valve may be configured to prevent the flow of the fluid through the outlet into the cavity. The second valve may allow flow of fluid only in one direction. The first valve and/or the second value may be passive flow control valves.

In various embodiments, at least one matrix unit of the plurality of matrix units 202 may be a self-circulation matrix unit. The pump of the self-circulation matrix unit has a cavity with an inlet and an outlet. The inlet and the outlet may be openings in the cavity. The fluid may flow into the cavity through the inlet, and may flow out of the cavity through the outlet.

A first channel of the plurality of channels of the self-circulation matrix unit may be an inlet channel connecting the chamber of the self-circulation matrix unit and the inlet of the pump of the self-circulation matrix unit.

A second channel of the plurality of channels of the self-circulation matrix unit may be an outlet channel connecting the chamber of the self-circulation matrix unit and the outlet of the pump of the self-circulation matrix unit.

The actuator of the driving layer (or region) of the self-circulation matrix unit and the cavity of the pump of the self-circulation matrix unit may define an enclosed space so that the enclosed space is increased when the actuator moves in a first direction to direct the fluid into the cavity (of the pump of the self-circulation matrix unit), and the enclosed space is decreased when the actuator moves in a second direction to direct the fluid out of the cavity (of the pump of the self-circulation matrix unit).

The self-circulation matrix unit may further include one or more incoming connection channels configured to direct the fluid from another matrix unit of the plurality of matrix units 202 or another part of the board 200 to the self-circulation matrix unit.

The self-circulation matrix unit may further include one or more outgoing connection channels configured to direct the fluid from the self-circulation matrix unit to yet another matrix unit of the plurality of matrix units 202 or yet another part of the board.

The inlet of the pump of the self-circulation matrix unit may include a first valve configured to allow flow of the fluid to the cavity of the pump of the self-circulation matrix unit. The first valve may be configured to prevent the flow of the fluid from the cavity through the inlet out of the cavity. The first valve may allow flow of fluid only in one direction.

The outlet of the pump of the self-circulation matrix unit may include a second valve configured to allow flow of the fluid out of the cavity of the pump of the self-circulation matrix unit. The second valve may be configured to prevent the flow of the fluid through the outlet into the cavity. The second valve may allow flow of fluid only in one direction. The first valve and/or the second value may be passive flow control valves.

In various embodiments, the board 200 may also include one or more additional Channels or connection channels connecting one matrix unit with another matrix unit. For instance, a connection channel may connect the outlet channel of the delivering matrix unit with an incoming connection channel of the self-circulating matrix unit or an inlet channel of a receiving unit. A connection channel may connect an outgoing connection channel of the self-circulating matrix unit with an inlet channel of a receiving unit. The one or more additional channels may be included in the channel layer (or region), the base channel sub-layer (or sub-region), or the jumping channel sub-layer (or sub-region).

The microfluidic board 200 may also include a controller in electrical connection to the plurality of matrix units 202. The controller may control the operation of the microfluidic board 200. The controller may be a microcontroller or a processor. In various embodiments, the controller may be configured so that two or more matrix units of the plurality of matrix units 202 are in operation simultaneously. The controller may be configured to operate two or more matrix units simultaneously by appropriate algorithm inputted or downloaded into the controller.

In various embodiments, the controller may be configured so that the plurality of matrix units 202 is in operation in a sequential manner. The controller may be configured to operate two or more matrix units in a sequential manner by appropriate algorithm inputted or downloaded into the controller.

In various embodiments, the controller may be configured to operate a few matrix units simultaneously, while may also be configured to operate other matrix units in a sequential manner. In various embodiments, the controller may be configured to operate matrix units simultaneously at one point in time, and may be configured to operate matrix units in a sequential manner at another point in time.

The microfluidic board 200 may further include a filter configured to trap particles above a predetermined size from the fluid.

In various embodiments, the fluid may be or may include one or more reactant or starting solutions, and one or more resultant solutions. For avoidance of doubt, in the current context, a fluid may also refer to a pure liquid, a gas, a solution, a suspension, a colloid, or any substance suitable to be transported via fluidic or microfluidic means.

Figure 3A:
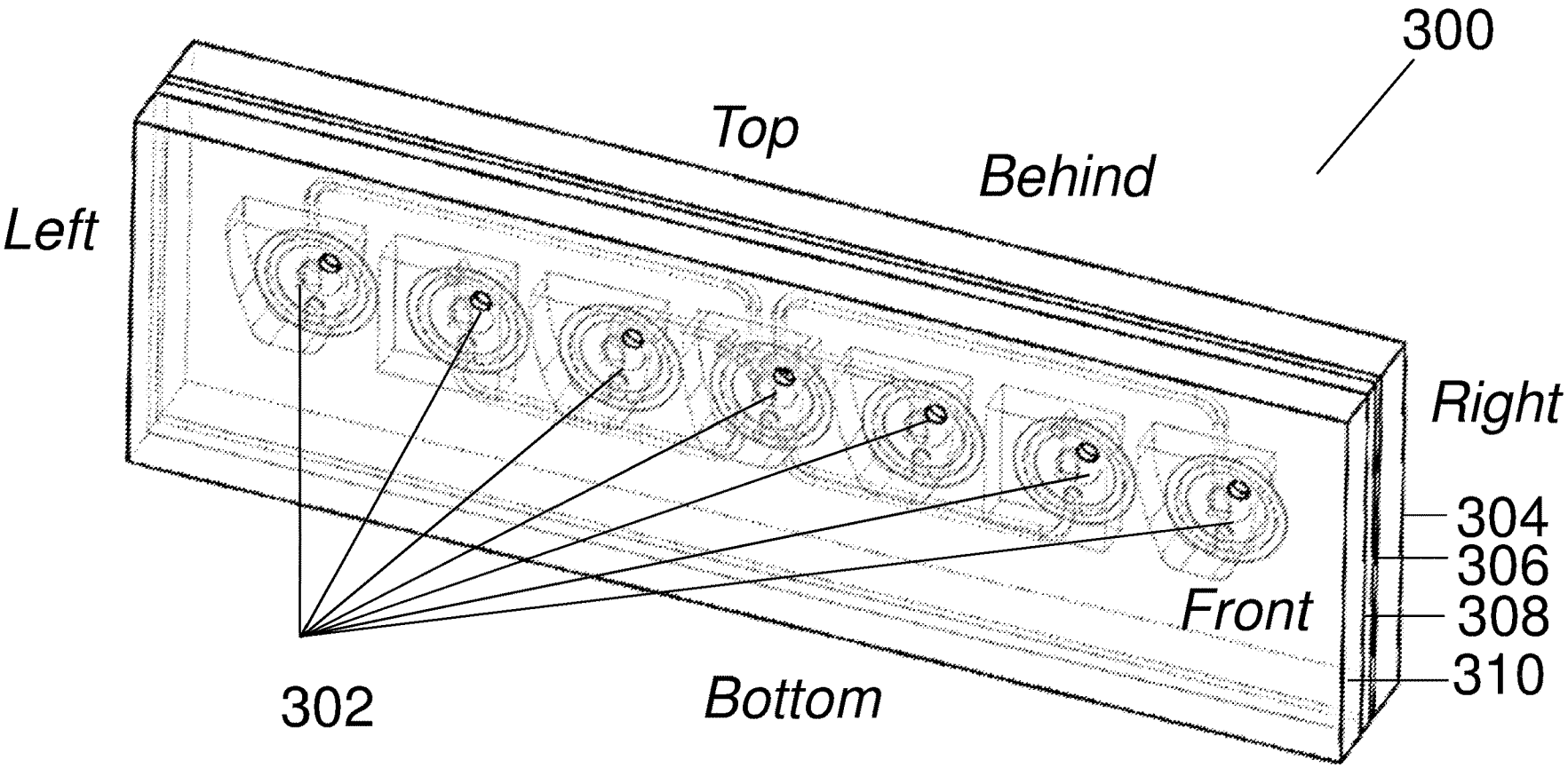
FIG. 3A is a schematic showing a perspective view of a microfluidic board according to various embodiments.

FIG. 3A is a schematic showing a perspective view of a microfluidic board 300 according to various embodiments. The microfluidic board 300 may include a plurality of matrix units 302, i.e., 7 matrix units 302 arranged in a 1×7 matrix. During operation, the front surface may be vertical and may face the user. The bottom surface may be horizontal.

The microfluidic board 300 may have a layered structure. The board 300 may include a driving layer 304, a pump layer 306 in contact with the driving layer 304, a channel layer 308 in contact with the pump layer 306, and a chamber layer 310 in contact with the channel layer 308.

The driving layer 304 may be a continuous layer formed from the driving portions of the plurality of matrix units 302. Likewise, the pump layer 306 may be a continuous layer formed from the pump portions of the plurality of matrix units 302, the channel layer 308 may be a continuous layer formed from the channel portions of the plurality of matrix units 302, and the chamber layer 310 may be a continuous layer formed from the chamber portions of the plurality of matrix units 302.

The driving layer 304 may include driving actuators, which generates the force to drive the pumps in the pump layer 306. The pumps may drive fluid or liquid to flow in the channels, e.g., microchannels, in the channel layer 308. The channels may connect different chambers in the chamber layer 310, and may be configured to allow the transfer of the fluid or liquid between the different chambers. The four layers 304, 306, 308, 310 may be sealed together according to the abovementioned sequence.

When viewed from the front direction, i.e., from chamber layer to driving layer, the microfluidic board may be divided into many units. The units may be arranged to be a matrix to realize a required function, and may be referred to as matrix units.

In each unit, the four partitioned layers or portions may follow the sequence of the different layers 304, 306, 308, 310. The driving portion may be behind, the pump portion may be in front of the driving portion, the channel portion may be in front of the pump portion, and the chamber portion may be in front of the channel portion. There may not be a lateral shift of the four components.

In various embodiments, the board 300 may be vertically aligned. The matrix units 302 may be orientated in the same direction, with outlet opening at the top and inlet opening at the bottom. Each matrix unit may be able to work independently as a whole.

Figure 3B:
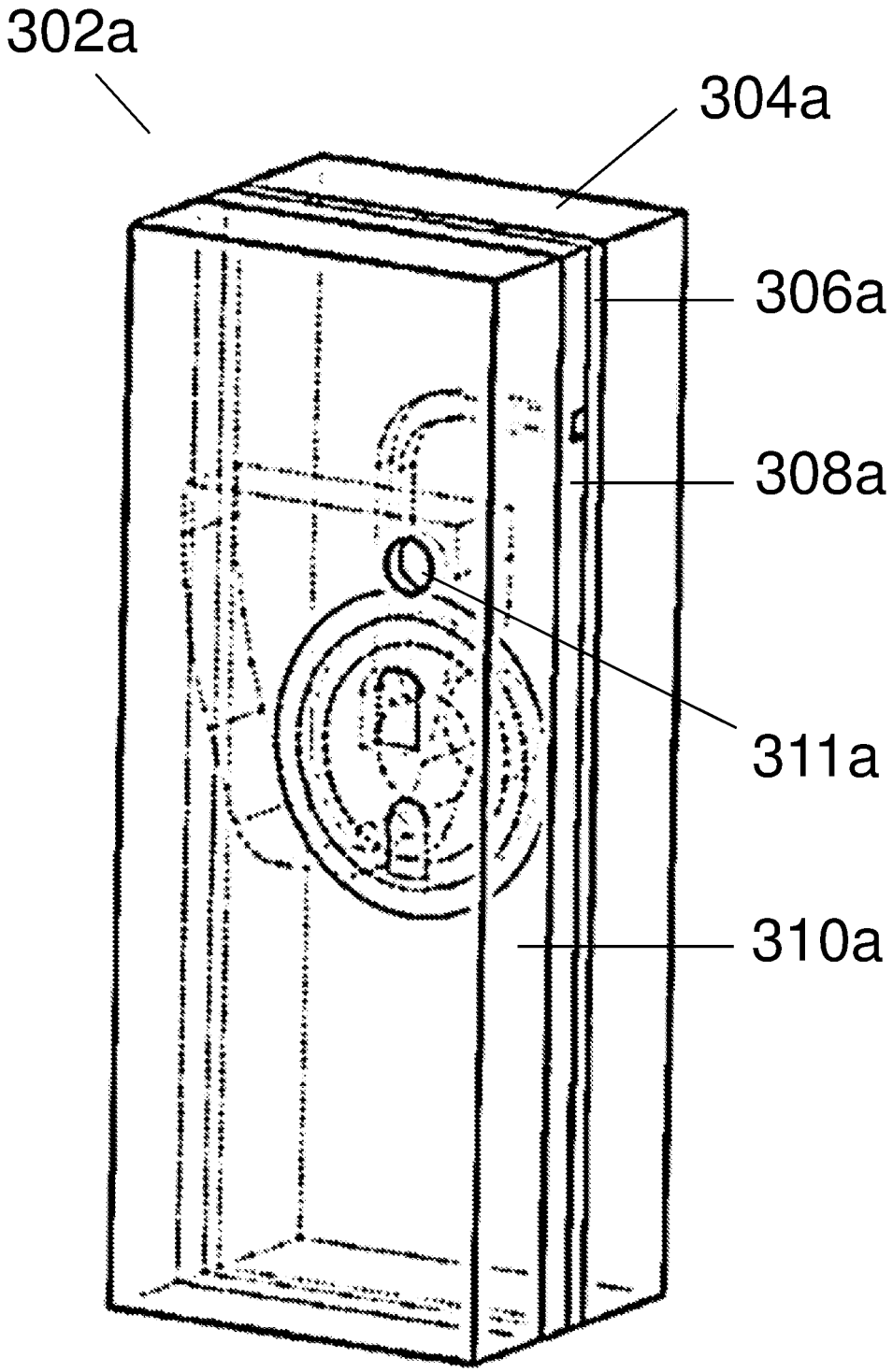
FIG. 3B shows a perspective view of a delivering matrix unit according to various embodiments.
Figure 3C:
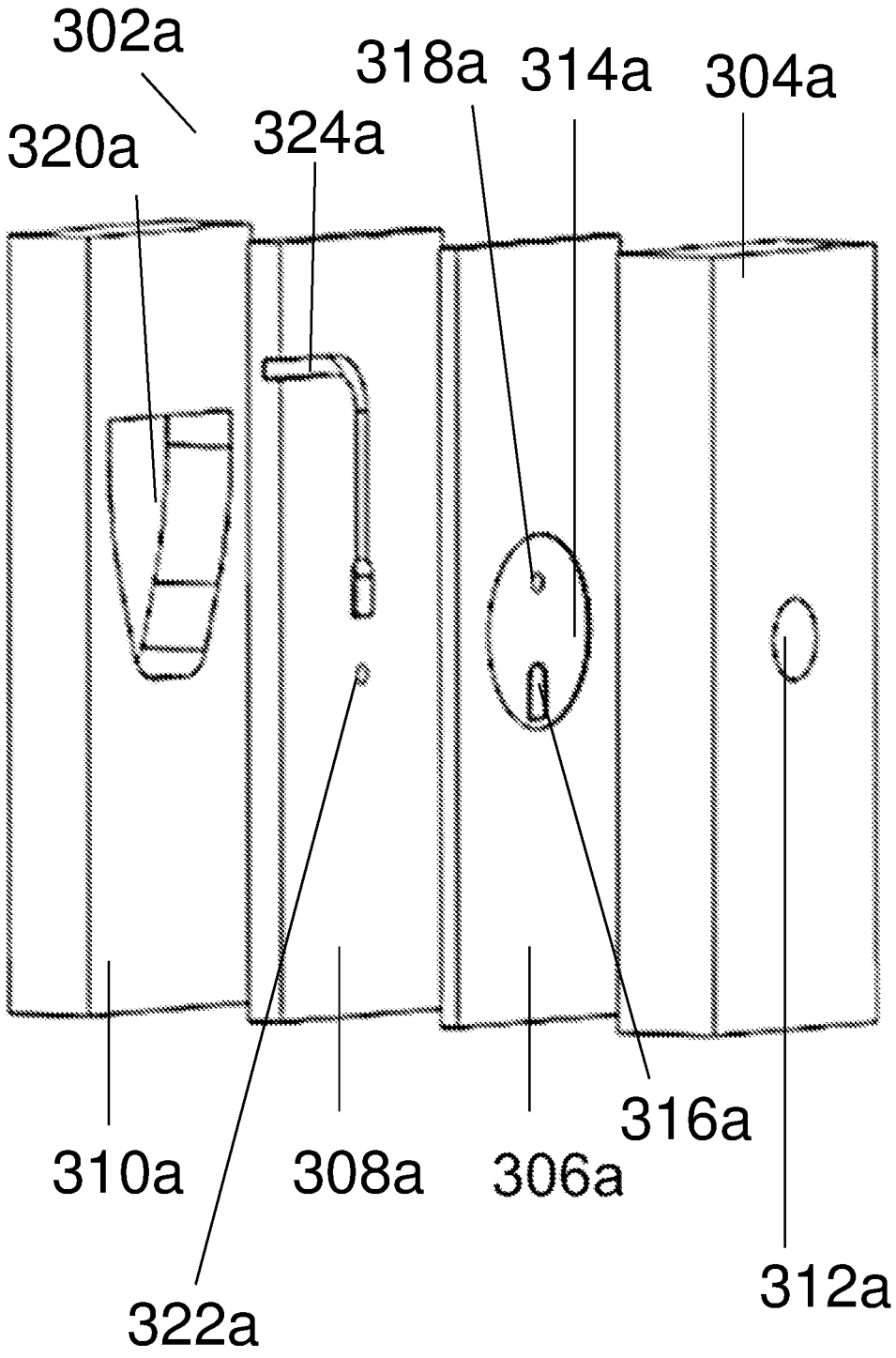
FIG. 3C shows an exploded view of the delivering matrix unit according to various embodiments.

In various embodiments, at least one matrix unit of the plurality of matrix units 302 may be a delivering matrix unit. FIG. 3B shows a perspective view of a delivering matrix unit 302*a* according to various embodiments. FIG. 3C shows an exploded view of the delivering matrix unit 302*a* according to various embodiments. The delivering matrix unit 302*a* may be or may include a stacked arrangement. The stacked arrangement may include a driving portion 304*a* including an actuator 312*a*. The stacked arrangement may also include a pump portion 306*a* in contact with the driving portion 304*a*, the pump portion 306*a* including a pump. The pump of the delivering matrix unit 302*a* may include a cavity 314*a* with an inlet 316*a* and an outlet 318*a*. The cavity 314*a* may be at the back surface of the pump portion 306*a*, and may together with the surface of the actuator 312*a* of the driving portion 304*a* form an enclosed space (i.e., partially enclosed space with the inlet and outlet as openings). Accordingly, the actuator 312*a* of the driving portion 304*a* of the delivering matrix unit 302*a* and the cavity of the pump of the delivery matrix unit 302*a* may define the enclosed space so that the enclosed space is increased when the actuator moves in a first direction to direct the fluid or liquid into the cavity (of the pump of the delivery matrix unit 302*a*), and the enclosed space is decreased when the actuator moves in a second direction to direct the fluid or liquid out of the cavity (of the pump of the delivery matrix unit 302*a*).

The inlet 316*a* of the pump of the delivering matrix unit 302*a* may include a first valve (also referred to as a check valve) configured to allow flow of the fluid or liquid to the cavity 314*a* of the pump of the delivering matrix unit 302*a*. The outlet 318*a* of the pump of the delivering matrix unit 302*a* may include a second valve (also referred to as a check valve) configured to allow flow of the fluid or liquid out of the cavity of the pump of the delivering matrix unit 302*a*. The first valve and the second valve may each be configured to allow flow of the fluid or liquid in only one direction. The first valve and the second value may be passive flow control valves.

The actuator 312*a* may be any displacement type of actuator. For example, the actuator 312*a* may be a piezoelectric actuator, an electromagnetic actuator, a shape memory alloy actuator, a hydraulic actuator, a pneumatic actuator, a thermal actuator, etc.

The stacked arrangement may also include a channel portion 308*a* in contact with the pump portion 306*a*. The stacked arrangement may additionally include a chamber portion 310*a* in contact with the channel portion 308*a*, the chamber portion including a chamber 320*a*. The channel portion 308*a* may include an inlet channel 322*a* connecting the chamber 320*a* of the delivering matrix unit 302*a* and the inlet 316*a* of the pump of the delivering matrix unit 302*a*. The inlet channel 322*a* may be a through hole extending from a first surface of the channel portion 308*a* to a second surface of the channel portion 308*a* opposite the first surface. The channel portion 308*a* may also include an outlet channel 324*a* connected to the outlet 318*a* of the pump of the delivering matrix unit 302*a*. The outlet channel 324*a* may be a microchannel, and may be configured to direct the fluid or liquid out from the delivering matrix unit 302*a*. In other words, the fluid or liquid may flow from the delivering matrix unit 302*a* to the other parts of the board 300 via the outlet channel 324*a*. The chamber 320*a* may include a hole

311*a* to maintain the air pressure balance. The hole 311*a* may be at a top portion of the front surface of the unit 302*a*.

During operation, fluid or liquid may be sucked from the chamber 320*a* via the inlet channel 322*a* to the pump, which may then pump the fluid or liquid to other parts of the hoard 300 via the outlet channel 324*a*. For maximizing the usage of the fluid or liquid, the opening of the inlet 316*a* of the pump may be arranged to be located at the bottom portion of the unit 302*a* (or cavity 314*a*), aligned with the bottom portion of the chamber 320*a*. The chamber 320*a* may have a top-big-bottom-small funnel-like shape.

Figure 3D:
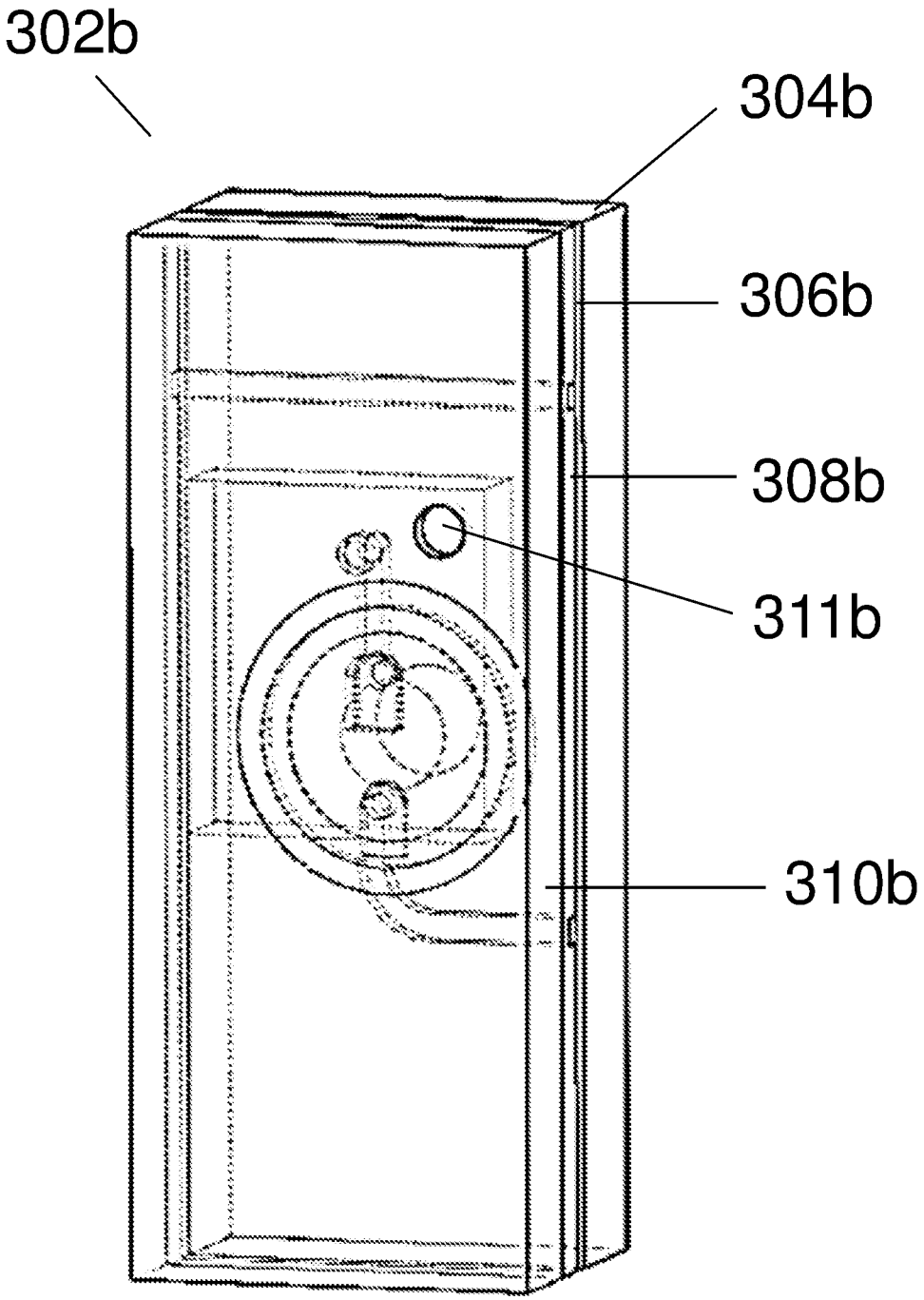
FIG. 3D shows a perspective view of a receiving matrix unit according to various embodiments.
Figure 3E:
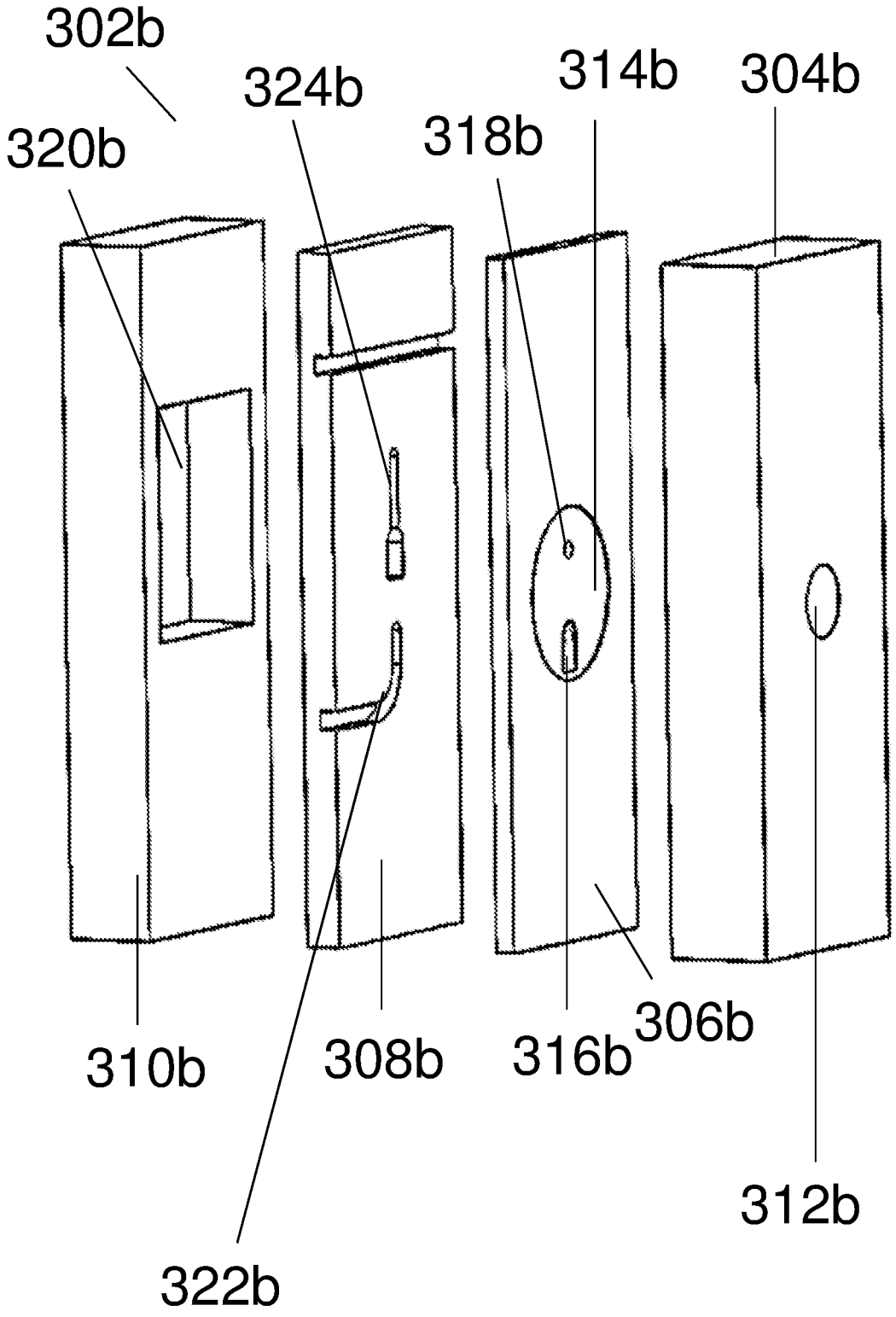
FIG. 3E shows an exploded view of the receiving matrix unit according to various embodiments.

In various embodiments, at least one matrix unit of the plurality of matrix units 302 may be a receiving matrix unit. FIG. 3D shows a perspective view of a receiving matrix unit 302*b* according to various embodiments. FIG. 3E shows an exploded view of the receiving matrix unit 302*b* according to various embodiments. The receiving matrix unit 302*b* may be or may include a stacked arrangement. The stacked arrangement may include a driving portion 302*b* including an actuator 312*b*. The stacked arrangement may also include a pump portion 306*b* in contact with the driving portion 304*b*, the pump portion 306*b* including a pump. The pump of the receiving matrix unit 302*b* may include a cavity 314*b* with an inlet 316*b* and an outlet 318*b*. The cavity 314*b* may be at the back surface of the pump portion 306*b*, and may together with the surface of the actuator 312*b* of the driving portion 304*b* form an enclosed space (i.e., partially enclosed space with the inlet and outlet as openings). Accordingly, the actuator 312*b* of the driving portion 304*b* of the receiving matrix unit 302*b* and the cavity of the pump of the receiving matrix unit 302*b* may define the enclosed space so that the enclosed space is increased when the actuator moves in a first direction to direct the fluid or liquid into the cavity (of the pump of the receiving matrix unit 302*b*), and the enclosed space is decreased when the actuator 312*b* moves in a second direction to direct the fluid or liquid out of the cavity (of the pump of the receiving matrix unit 302*b*).

The actuator 312*b* may be any displacement type of actuator. For example, the actuator 312*b* may be a piezoelectric actuator, an electromagnetic actuator, a shape memory alloy actuator, a hydraulic actuator, a pneumatic actuator, a thermal actuator, etc.

The stacked arrangement may also include a channel portion 308*b* in contact with the pump portion 306*b*. The stacked arrangement may additionally include a chamber portion 310*b* in contact with the channel portion 308*b*, the chamber portion including a chamber 320*b*. The chamber 320*b* may include a hole 311*b* to maintain the air pressure balance. The channel portion 308*b* may include an inlet channel 322*b* connected to the inlet 316*b* of the pump of the receiving matrix unit 302*b*. The inlet channel 322*b* may be configured to direct the fluid or liquid to the receiving matrix unit 302*b*. In other words, the fluid or liquid may flow from other parts of the board 300 to the receiving matrix unit 302*b* via the inlet channel 322*b*. The channel portion 308*a* may also include an outlet channel 324*b* connecting the chamber 320*b* of the receiving matrix unit 302*b* and the outlet 318*b* of the pump of the receiving matrix unit 302*b*.

The receiving matrix unit 302*b* may initially not contain any fluid or liquid. When the pump of the receiving matrix unit 302*b* is actuated, the fluid or liquid may be sucked (from other parts of the board 320, e.g., another chamber of another unit) into the chamber 320*b* via inlet channel 322*b*, which may be a microchannel, to the pump. The liquid or fluid may then flow through the outlet channel 324*b* to the chamber 320*b*.

Figure 3F:
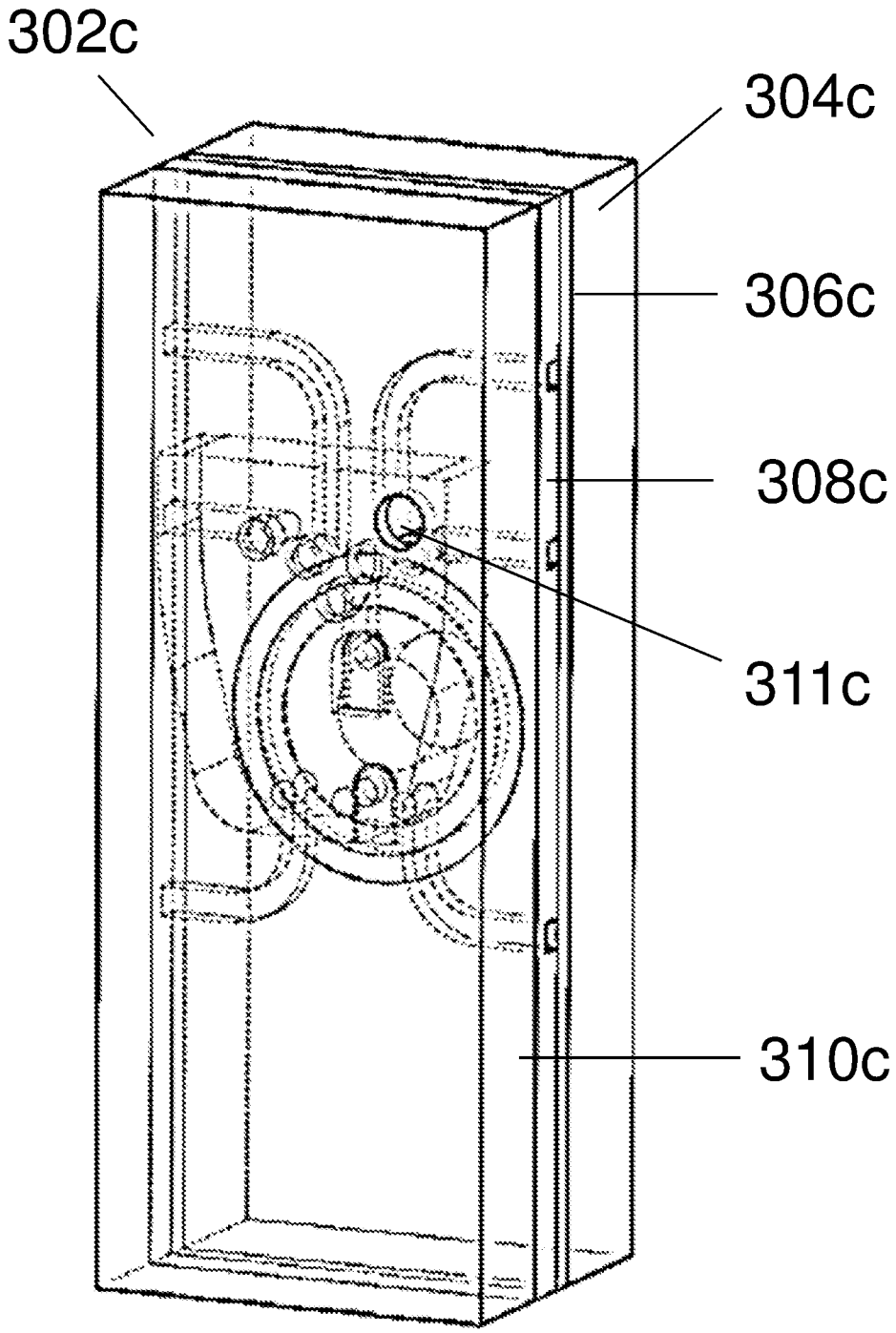
FIG. 3F shows a perspective view of a self-circulation matrix unit according to various embodiments.
Figure 3G:
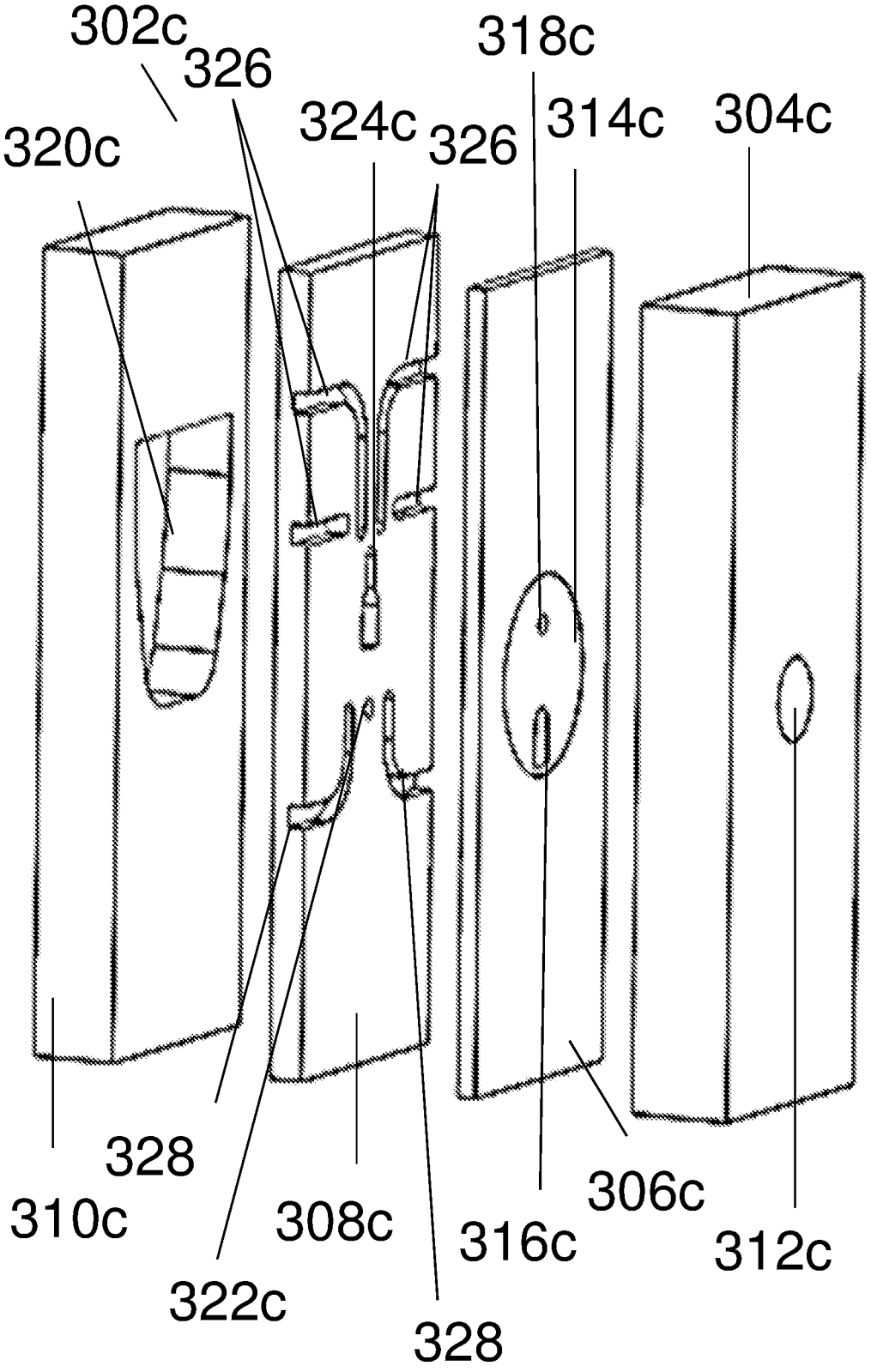
FIG. 3G shows an exploded view of the self-circulation matrix unit according to various embodiments.

In various embodiments, at least one matrix unit of the plurality of matrix units 302 may be a self-circulation matrix unit. FIG. 3F shows a perspective view of a self-circulation matrix unit 302*c* according to various embodiments. FIG. 3G shows an exploded view of the self-circulation matrix unit 302*c* according to various embodiments. The self-circulation matrix unit 302*c* may be or may include a stacked arrangement. The stacked arrangement may include a driving portion 304*c* including an actuator 312*c*. The stacked arrangement may also include a pump portion 306*c* in contact with the driving portion 304*c*, the pump portion 306*c* including a pump. The pump of the self-circulation matrix unit 302*c* may include a cavity 314*c* with an inlet 316*c* and an outlet 318*c*. The cavity 314*c* may be at the back surface of the pump portion 306*c*, and may together with the surface of the actuator 312*c* of the driving portion 304*c* form an enclosed space (i.e., partially enclosed space with the inlet and outlet as openings). Accordingly, the actuator 312*c* of the driving portion 304*c* of the self-circulation matrix unit 302*c* and the cavity of the pump of the self-circulation matrix unit 302*c* may define the enclosed space so that the enclosed space is increased when the actuator moves in a first direction to direct the fluid or liquid into the cavity (of the pump of the self-circulation matrix unit 302*c*), and the enclosed space is decreased when the actuator 312*c* moves in a second direction to direct the fluid or liquid out of the cavity (of the pump of the self-circulation matrix unit 302*c*).

The actuator 312*c* may be any displacement type of actuator. For example, the actuator 312*c* may be a piezoelectric actuator, an electromagnetic actuator, a shape memory alloy actuator, a hydraulic actuator, a pneumatic actuator, a thermal actuator, etc.

The stacked arrangement may also include a channel portion 308*c* in contact with the pump portion 306*c*. The stacked arrangement may additionally include a chamber portion 310*c* in contact with the channel portion 308*c*, the chamber portion including a chamber 320*c*. The chamber 320*c* may include a hole 311*c* to maintain the air pressure balance. The channel portion 308*c* may include an inlet channel 322*c* connecting the chamber 320*c* of the self-circulation matrix unit 302*c* and the inlet 316*c* of the pump of the self-circulation matrix unit 302*c*.

The channel portion 308*c* may also include an outlet channel 324*c* connecting the chamber of the self-circulation matrix unit 302*c* and the outlet 318*c* of the pump of the self-circulation matrix unit 302*c*.

The channel portion 308*c* may further include one or more incoming connection channels 326 configured to direct the fluid or liquid from another matrix unit of the plurality of matrix units 302 to the self-circulation matrix unit 302*c* (e.g., to chamber 320*c*). The channel portion 308*c* may additionally include one or more outgoing connection channels 328 configured to direct the fluid or liquid from the self-circulation matrix unit 302*c* (e.g., from chamber 320*c*) to yet another matrix unit of the plurality of matrix units 302.

The self-circulation matrix unit 302*c* may be configured to mix different liquid or fluids, e.g., solutions, or to serve as a site for reaction. Reactant solutions may be pumped into the self-circulation matrix unit 302*c*, and the resultant solutions may be pumped out of the self-circulation matrix unit 302*c*. The inlet channel 322*c* and the outlet channel 324*c* connect the pump and the chamber 320*c*. The fluids, liquids, solutions, etc. may be circulated between the pump and the chamber 302*c*, and may be mixed. The mixing of the fluids, liquids, solutions, etc. may thus accelerate the reaction. The chamber 320*c* may also include additional openings. The additional openings may be at a top portion and a bottom portion of the chamber 320*c*. A portion of the additional openings, e.g. the top openings, may be in fluidic communication with the one or more incoming connection channels 326. The reactant solutions may be introduced into the chamber 320*c* from other parts of the board 300 via the one or more incoming connection channels 326. Another portion of the additional openings, e.g. the bottom openings, may be in fluidic communication with the one or more outgoing connection channels 328. The resultant solutions may be pumped out or sucked out through the one or more outgoing connection channels 328.

Figure 4A:
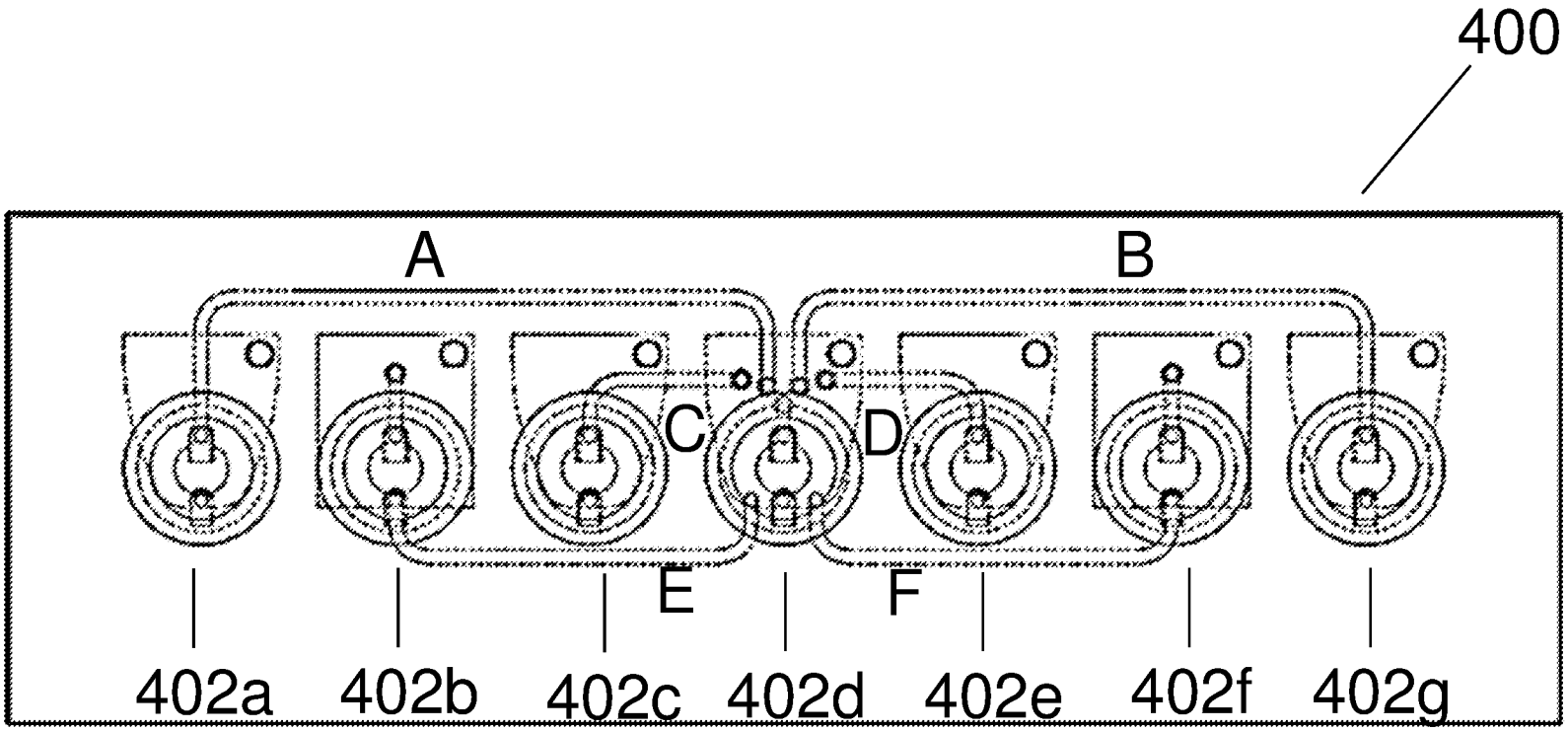
FIG. 4A is a schematic showing a front surface of a microfluidic board having a 1×7 matrix according to various embodiments.
Figure 4B:
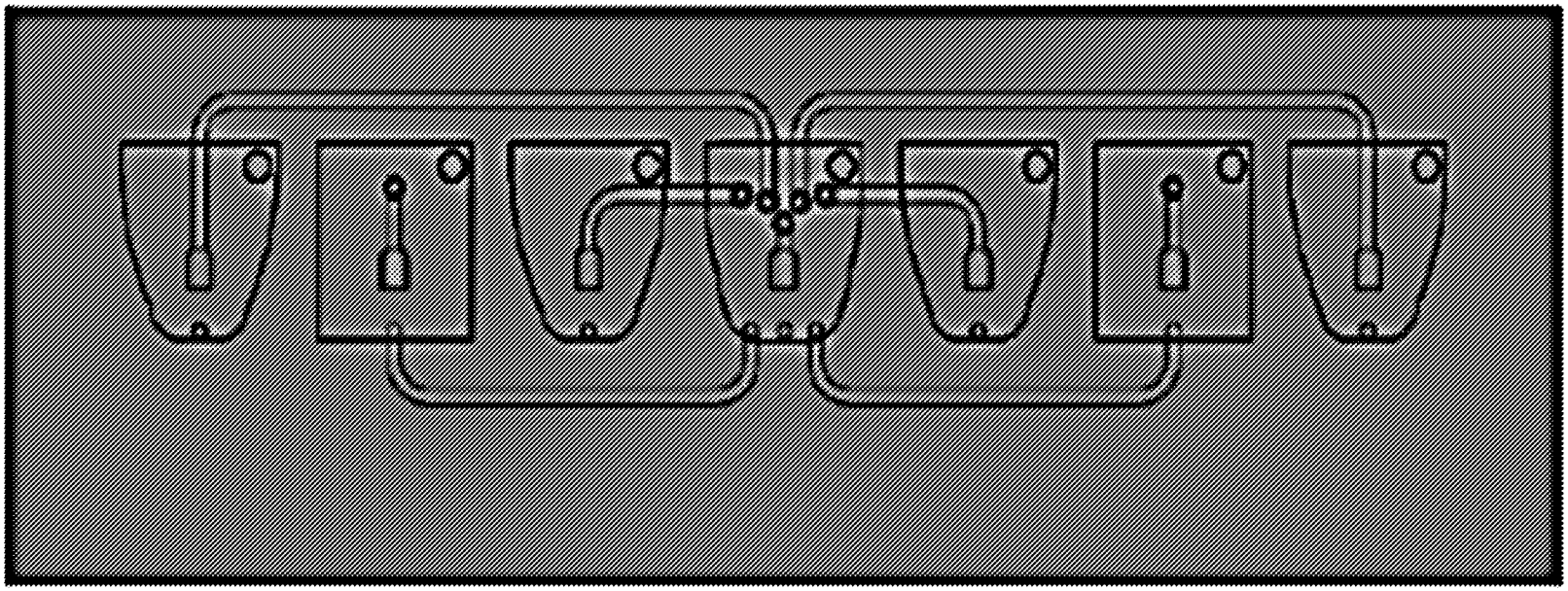
FIG. 4B is an optical image of the microfluidic board according to various embodiments.

FIG. 4A is a schematic showing a front surface of a microfluidic board 400 having a 1×7 matrix according to various embodiments. As shown in FIG. 4A, the board may include 7 matrix units 402*a-g* arranged in a row. FIG. 4B is an optical image of the microfluidic board 400 according to various embodiments.

The matrix units 402*a-g* may be connected with connection channels A-F. Matrix units 402*a*, 402*c*, 402*e*, and 402*g* may be delivering matrix units, matrix unit 402*d* may be a self-circulation matrix unit, and matrix units 402*b* and 402*f* may be receiving matrix units. Starting fluids or liquids from chambers in matrix units 402*a*, 402*c*, 402*e*, and 402*g* may be pumped into self-circulation matrix unit 402*d* through connection channels A-D. Reaction may occur between the starting fluids or liquids, and the resultant fluids or liquids may be sucked into the chambers in matrix units 402*b* and 402*f* through connection channels E-F. The board 400 may, for instance, be used for deoxyribonucleic acid (DNA) extraction. For instance, chambers in matrix units 402*a*, 402*c*, 402*e*, and 402*g* may respectively store the sample, the lysis buffer, a wash solution, and an elution solution. The chamber in unit 402*d* may serve as an extraction chamber, and may store the extraction resin. The resin may extract the nucleic acid from the sample with the aid of the lysis buffer and the wash solution. The generated waste may be pumped into the chamber in matrix unit 402*b*, while the resin may release the nucleic acid with the aid of the elution solution. The eluted solution may be pumped into the chamber in matrix unit 402*f*.

Figure 4C:
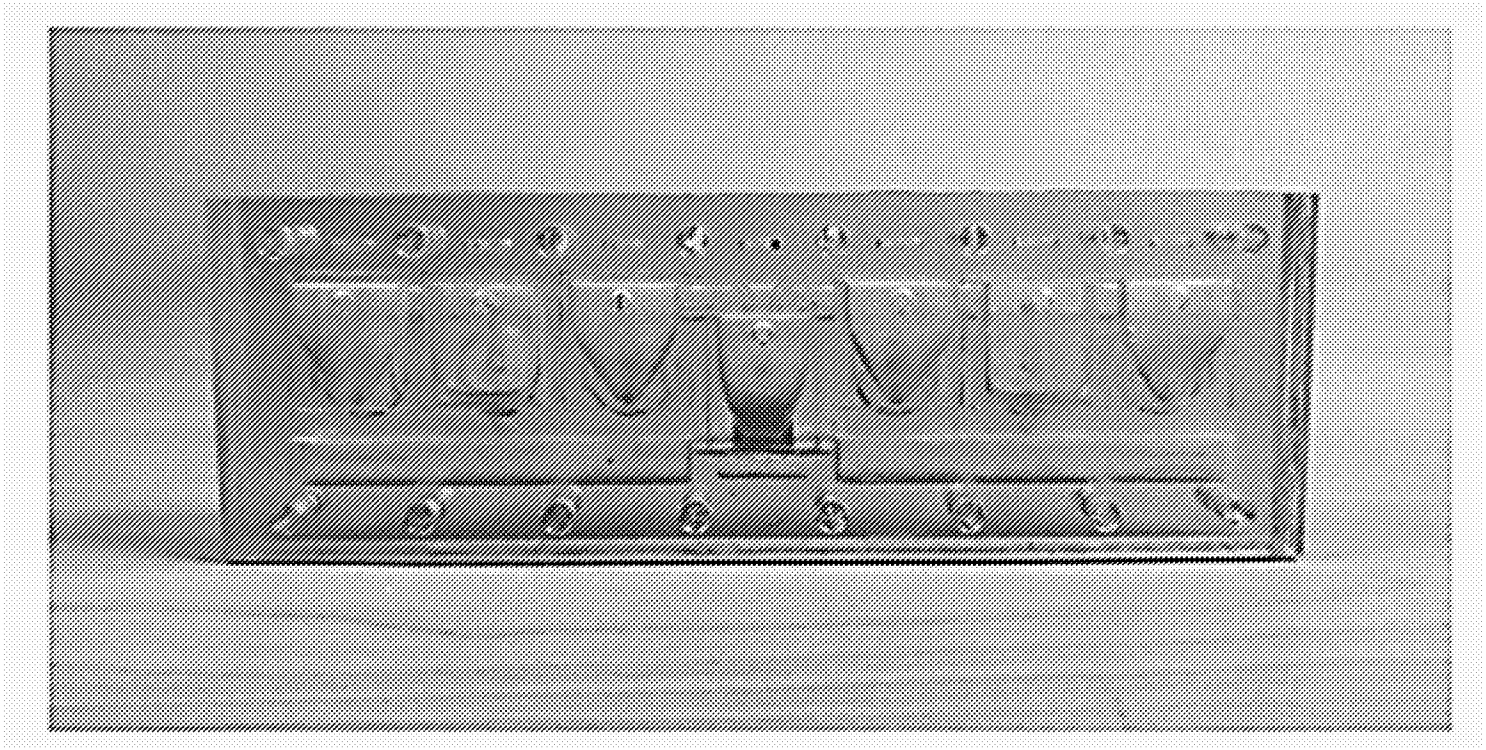
FIG. 4C is an image of a prototype of the microfluidic board according to various embodiments.

FIG. 4C is an image of a prototype of the microfluidic board 400 according to various embodiments. 1000 copies of DNA may be extracted using the microfluidic board 400.

Figure 5A:
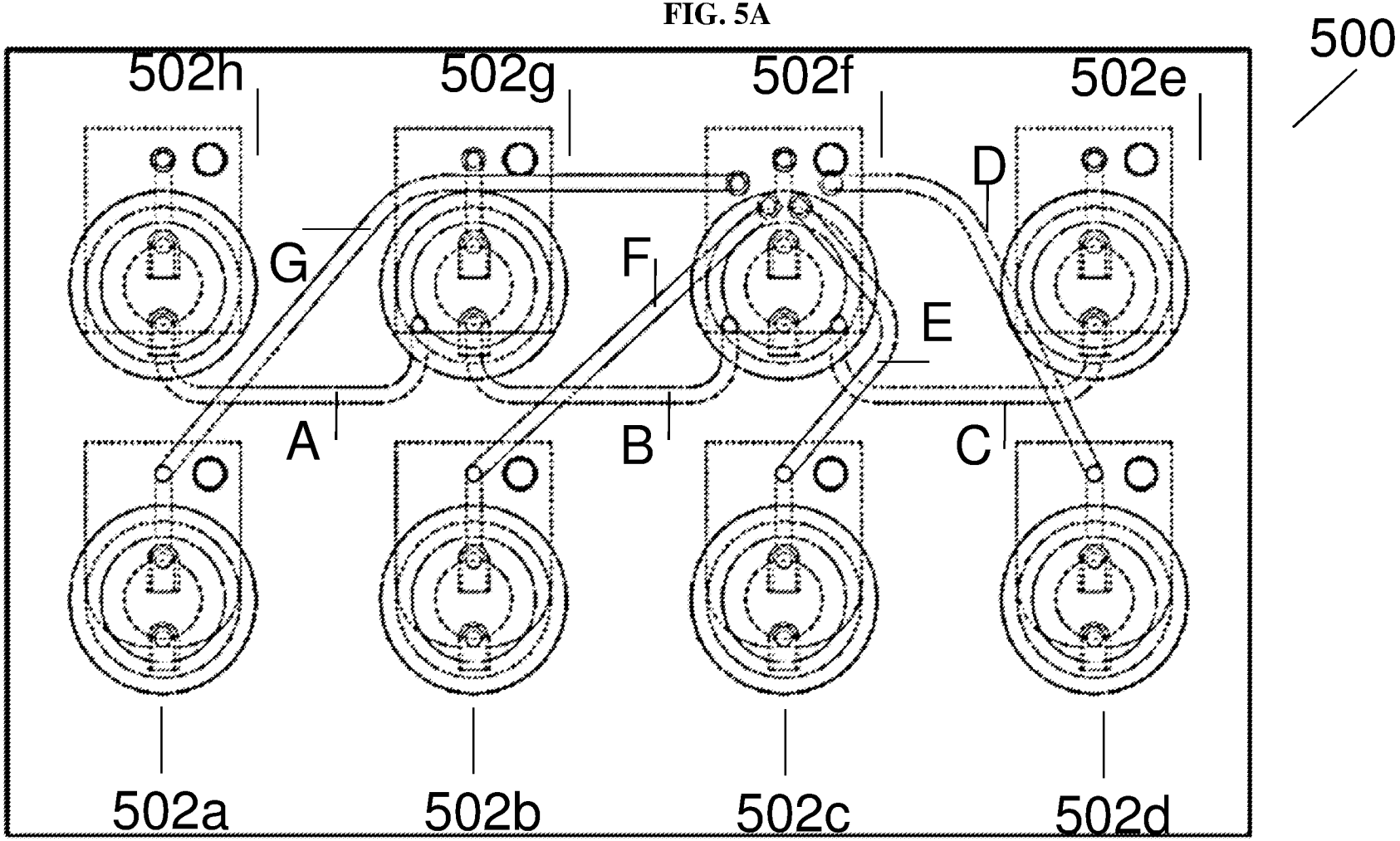
FIG. 5A is a schematic showing a front surface of a microfluidic board having a 2×4 matrix according to various embodiments.
Figure 5B:
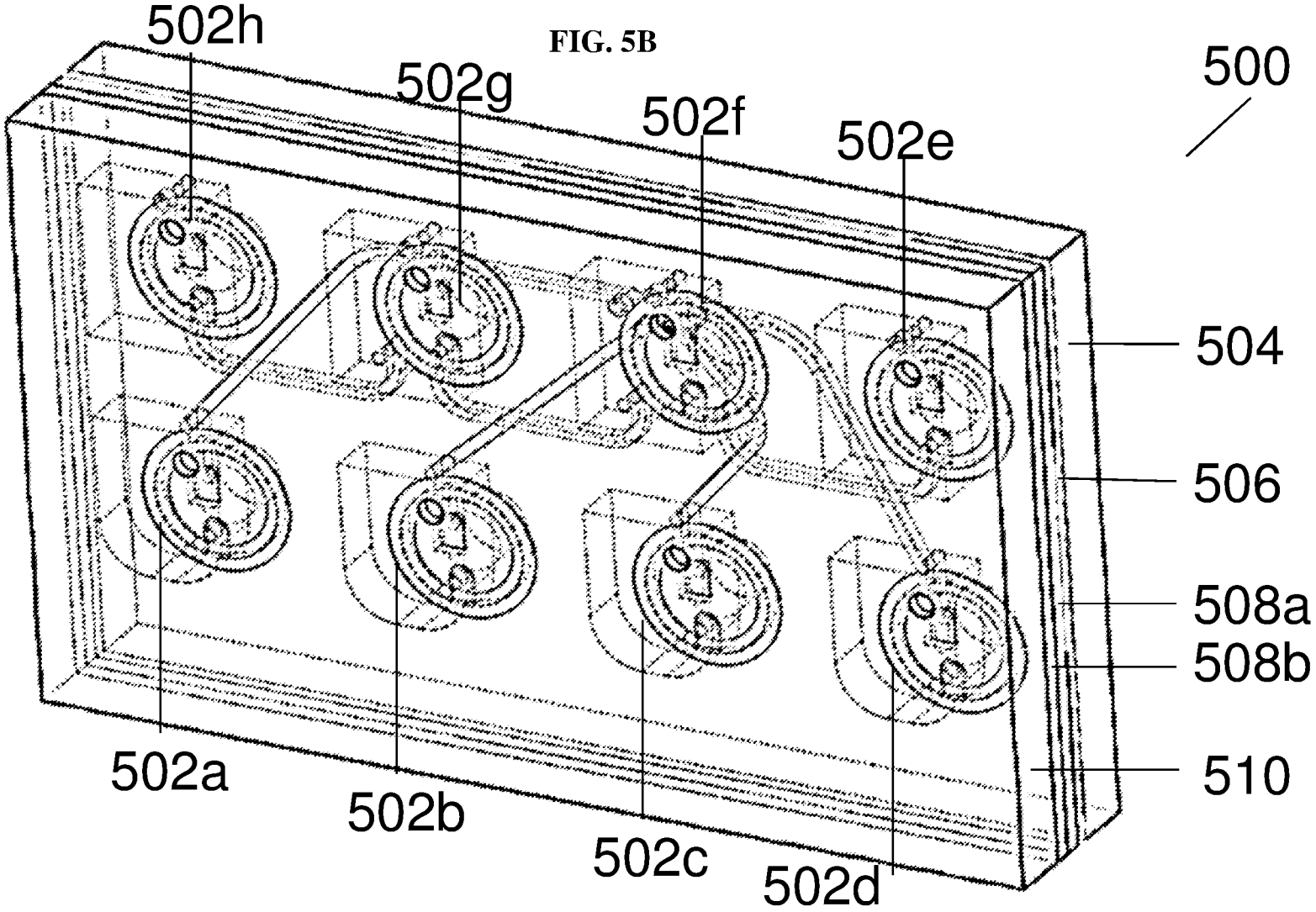
FIG. 5B is a schematic showing a perspective view of the microfluidic board according to various embodiments.

FIG. 5A is a schematic showing a front surface of a microfluidic board 500 having a 2×4 matrix according to various embodiments. FIG. 5B is a schematic showing a perspective view of the microfluidic board 500 according to various embodiments.

As shown in FIGS. 5A-B, the board 500 may include 4 matrix units 502*a-d* arranged in a first row, and another 4 matrix units 502*e-b* arranged in a second row. The board 500 may be used to realize complicated function, or may provide a compact solution to realize required functions.

For nucleic acid extraction, chambers of delivering matrix units 502*a-d* may be used to store the sample, the lysis buffer, the wash solution, and the elution solution, respectively. The chamber of self-circulation matrix unit 502*f* may be used for nucleic acid extraction. The chamber of receiving matrix unit 502*e* may be used for collection of waste, the chamber of receiving matrix unit 502*g* may be used for collection of extracted nucleic acid solution, and the chamber of receiving matrix unit 502*b* may be used for detection purposes.

The different chambers may be connected via the connecting channels A-G. As the network of channels is more complicated, there may be overlapping of the channels, for example, A with G, B with F, C with D and E. The overlap may sometimes be unavoidable for more complicated matrix designs.

Figure 5C:
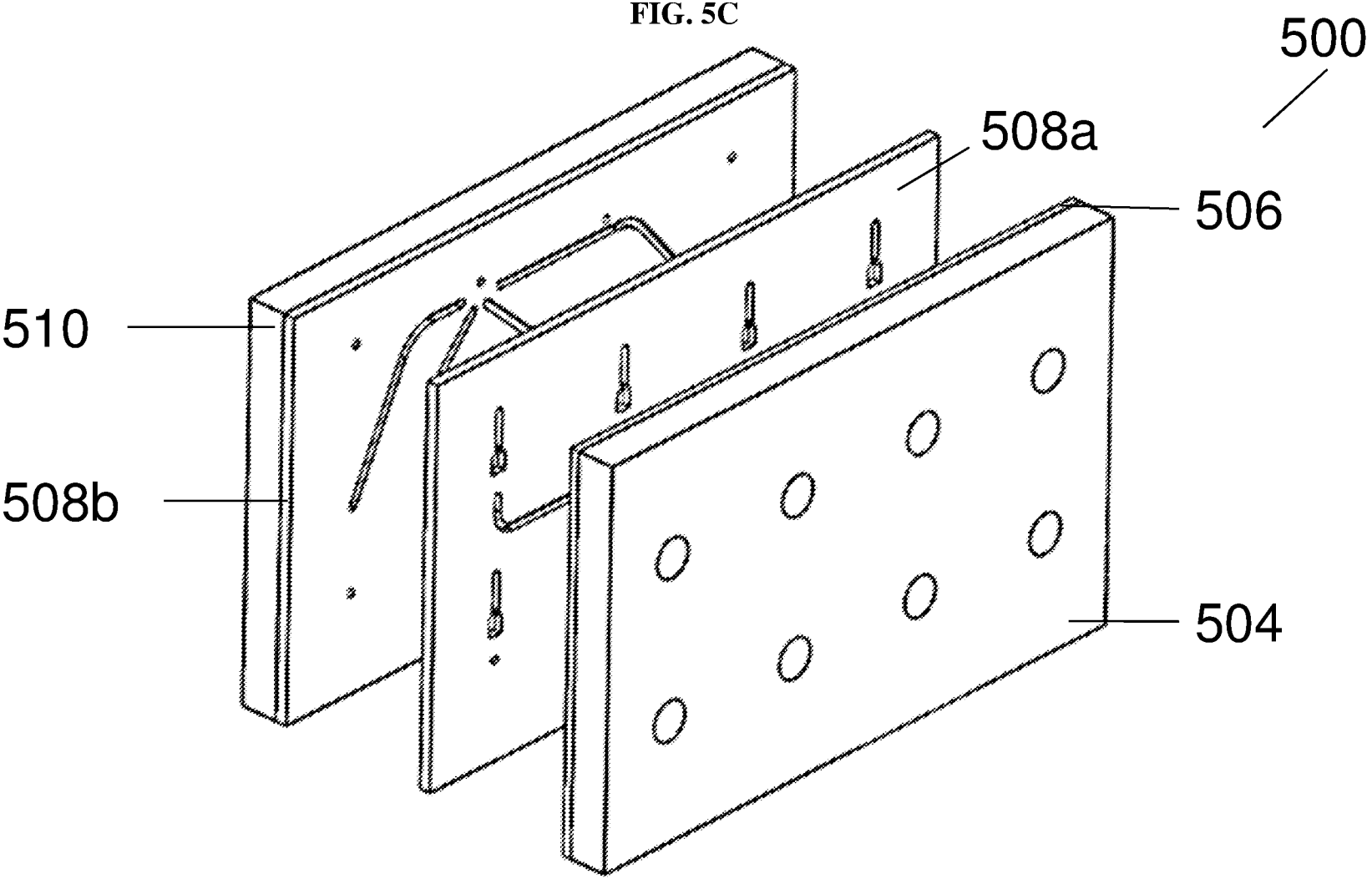
FIG. 5C is a schematic showing another perspective view of the microfluidic board according to various embodiments but with the base channel layer or sub-layer separated.

As shown in FIG. 5B, the board may include a driving layer 504, a pump layer 506 in contact with the driving layer 504, a base channel layer or sub-layer 508*a* in contact with the pump layer 506, a jumping channel layer or sub-layer 508*b* in contact with the base channel layer or sub-layer 508*a*, and a chamber layer 510 in contact with the jumping channel layer or sub-layer 508*b*. FIG. 5C is a schematic showing another perspective view of the microfluidic board 500 according to various embodiments but with the base channel layer or sub-layer 508*a* separated.

The jumping channel layer or sub-layer 508*b* may be placed in front of the base channel layer or sub-layer 508*a*. The connecting channels which overlap may be arranged in different layers or sub-layers, i.e., the jumping channel layer or sub-layer 508*b* and the base channel layer or sub-layer 508*a*. For instance, channels A, B, and C may be in the base channel layer or sub-layer 508*a*, while channels D, E, F, G may be in the jumping channel layer or sub-layer 508*b*. The two ends of a channel may connect two chambers. For instance, chamber of matrix unit 502*a* may be connected to the chamber of matrix unit 502*f* via channel G. The fluid or liquid may flow from one chamber to another chamber via the channel.

Figure 5D:
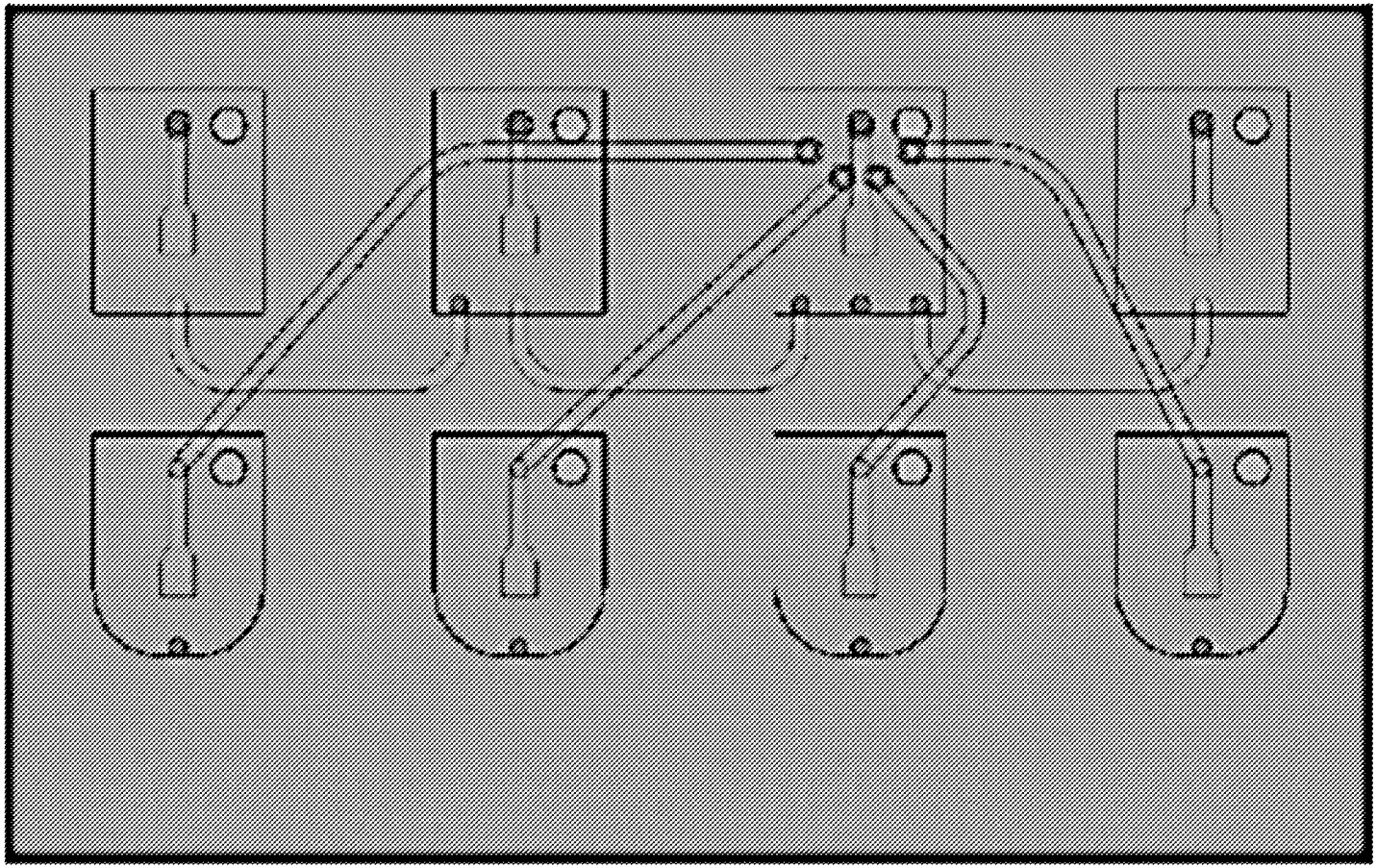
FIG. 5D is an optical image of the microfluidic board according to various embodiments.

FIG. 5D is an optical image of the microfluidic hoard 500 according to various embodiments.

In various embodiments, one or more accessories, such as a filter, may be included or installed on or in the microfluidic board. The filter may serve to trap or block large particles, and may be included or installed anywhere in the flow system.

As the microfluidic board is based on the matrix design, matrix units may be independent of one another. Therefore, the operation of the board may be quite flexible. Each matrix unit may work alone, or may work together with other matrix units at the same time. Programmable control may be used to operate the board.

In various embodiments, the microfluidic board may include a controller in electrical connection with the plurality of matrix units. For example, in the board 400 with a 1×7 matrix, the units 402*a, b, d* may work in the sequence. For instance, unit 402*a* may start operation, pump the fluid or liquid into unit 402*d*, then stop operation. After that, unit 402*d* may start operation, self-circulate the fluid or liquid, then stop. Finally, the unit 402*b* may start operation, and the fluid or liquid may be sucked into unit 402*b*. Operation may then stop. The units 402*a*, 402*b*, 402*d* can also work simultaneously: units 402*a, b, d* may start operation simultaneously, a continuous flow may be generated till the liquid or fluid, e.g., resultant solution, flow into chamber 402*b* before operations stop. The program may provide a plurality of options, and may be optimized based on practical applications.

Figure 6:
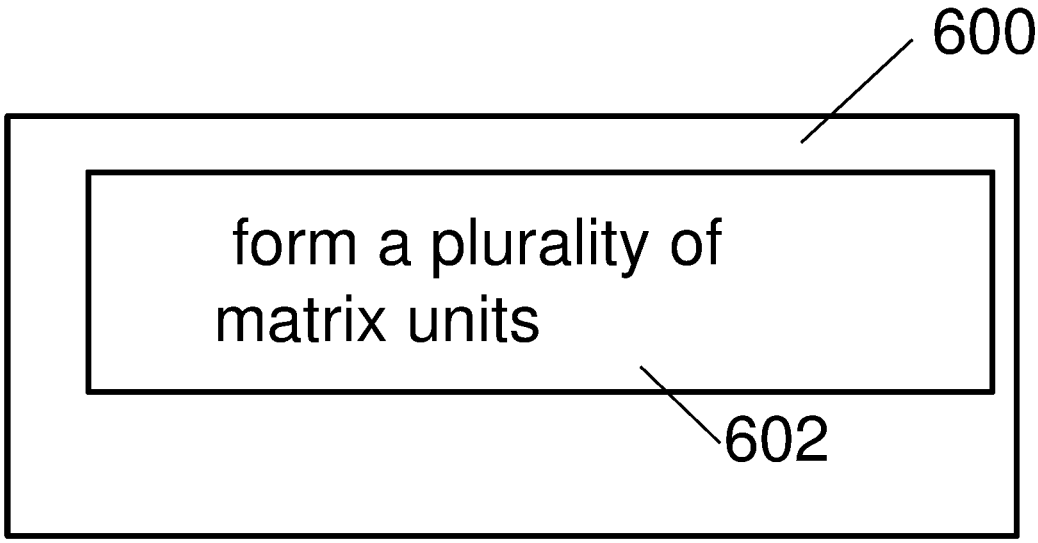
FIG. 6 is a schematic illustrating a method of forming a microfluidic board according to various embodiments.

FIG. 6 is a schematic illustrating a method of forming a microfluidic board 600 according to various embodiments. The method may include, in 602, forming a plurality of matrix units. Each matrix unit of the plurality of matrix units may be or may include a stacked arrangement. The stacked arrangement may include a driving portion including an actuator. The stacked arrangement may also include a pump portion in contact with the driving portion, the pump portion include a pump. The stacked arrangement may further include a channel portion in contact with the pump portion, the channel portion including one or more channels. The stacked arrangement may additionally include a chamber portion in contact with the channel portion, the chamber portion including a chamber. The one or more channels may be configured to direct fluid between the pump and the chamber. The actuator may be configured to generate a force to drive the pump upon receiving of an input energy.

In other words, the method of forming a microfluidic board may include forming a plurality of units, with each unit including a driving portion, a pump portion, a channel portion, and a chamber portion.

In various embodiments, the driving portions of the plurality of matrix units may form a driving layer (or region). The pump portions of the plurality of matrix units may form a pump layer (or region). The channel portions of the plurality of matrix units may form a channel layer (or region). The chamber portions of the plurality of matrix units may form a chamber layer (or region).

In various embodiments, the pump layer (or region) may be formed on the driving layer (or region). The channel layer (or region) may be formed on the pump layer (or region). The chamber layer (or region) may be formed on the channel layer (or region).

In various embodiments, the driving layer (or region) may be formed before forming the pump layer (or region). The pump layer (or region) may be formed before forming the channel layer (or region). The channel layer (or region) may be formed before forming the chamber layer (or region).

In various other embodiments, the driving layer (or region), the pump layer (or region), the channel layer (or region) and the chamber layer (or region) may be formed at the same time.

The channel layer (or region) may include a base channel sub-layer (or sub-region) and a jumping channel sub-layer (or sub-region). The base channel sub-layer (or sub-region) may be formed on the pump layer (or region). The jumping channel sub-layer (or sub-region) may be formed on the base channel sub-layer (or sub-region).

The matrix units may be arranged in a regular array or matrix.

In various embodiments, at least one matrix unit of the plurality of matrix units may be a delivering matrix unit. The pump of the delivering matrix unit may have a cavity with an inlet and an outlet. A channel of the one or more channels of the delivering matrix unit may be an inlet channel connecting the chamber of the delivering matrix unit and the inlet of the pump of the delivering matrix unit. The delivering matrix unit may also further include an outlet channel connected to the outlet of the pump of the delivering matrix unit. The outlet channel may be configured to direct the fluid out from the delivering matrix unit.

The actuator of the driving layer (or region) of the delivering matrix unit and the cavity of the pump of the delivering matrix unit may define an enclosed space so that the enclosed space is increased when the actuator moves in a first direction to direct the fluid into the cavity of the pump of the delivering matrix unit, and the enclosed space is decreased when the actuator moves in a second direction to direct the fluid out of the cavity of the pump of the delivering matrix unit.

The inlet of the pump of the delivering matrix unit may include a first valve configured to allow flow of the fluid to the cavity of the pump of the delivering matrix unit. The outlet of the pump of the delivering matrix unit may include a second valve configured to allow flow of the fluid out of the cavity of the pump of the delivering matrix unit. The first valve and the second value may be passive flow control valves.

In various embodiments, at least one matrix unit of the plurality of matrix units may be a receiving matrix unit. The pump of the receiving matrix unit may have a cavity with an inlet and an outlet. A channel of the one or more channels of the receiving matrix unit may be an outlet channel connecting the chamber of the receiving matrix unit and the outlet of the pump of the receiving matrix unit. The receiving matrix unit may further include an inlet channel connected to the inlet of the pump of the receiving matrix unit. The inlet channel may be configured to direct the fluid to the receiving matrix unit.

The actuator of the driving layer (or region) of the receiving matrix unit and the cavity of the pump of the receiving matrix unit may define an enclosed space so that the enclosed space is increased when the actuator moves in a first direction to direct the fluid into the cavity, and the enclosed space is decreased when the actuator moves in a second direction to direct the fluid out of the cavity.

In various embodiments, at least one matrix unit of the plurality of matrix units may be a self-circulation matrix unit. The pump of the self-circulation matrix unit may have a cavity with an inlet and an outlet. A first channel of the plurality of channels of the self-circulation matrix unit may be an inlet channel connecting the chamber of the self-circulation matrix unit and the inlet of the pump of the self-circulation matrix unit. A second channel of the plurality of channels of the self-circulation matrix unit may be an outlet channel connecting the chamber of the self-circulation matrix unit and the outlet of the pump of the self-circulation matrix unit.

The actuator of the driving layer (or region) of the self-circulation matrix unit and the cavity of the pump of the self-circulation matrix unit may define an enclosed space so that the enclosed space is increased when the actuator moves in a first direction to direct the fluid into the cavity, and the enclosed space is decreased when the actuator moves in a second direction to direct the fluid out of the cavity.

The self-circulation matrix unit may further include one or more incoming connection channels configured to direct the fluid from another matrix unit of the plurality of matrix units to the self-circulation matrix unit. The self-circulation matrix unit may further include one or more outgoing connection channels configured to direct the fluid from the self-circulation matrix unit to yet another matrix unit of the plurality of matrix units.

In various embodiments, the method may also include forming additional channels, e.g. connecting channels so that the chamber of one matrix unit is in fluidic communication with the chamber of another matrix unit.

In various embodiments, the method may also include electrically connecting a controller to the plurality of matrix units. The controller may be configured so that two or more matrix units of the plurality of matrix units are in operation simultaneously. In various embodiments, the controller may be configured so that the plurality of matrix units is in operation in a sequential manner. The method may further include forming a filter configured to trap particles above a predetermined size from the fluid.

Various embodiments may be vertically aligned. The matrix units may be orientated in the same direction, with outlet opening at the top and inlet opening at the bottom.

Various embodiments may be a board having four main layers. The board may include (from behind to front) a driving layer, a pump layer, a channel layer (base channel and jumping channel), and a chamber layer.

The board may be divided into repeatable matrix units. Each unit may include (from the behind to the front) a driving actuator portion, a pump portion, a channel portion (base channel and jumping channel), and a chamber portion. The portions may be in a fixed sequence and position.

There may be three types of matrix units: delivering matrix unit, receiving matrix unit and self-circulation matrix unit. Each unit may have an inlet and an outlet. For a delivering matrix unit, the inlet may be opened at the bottom portion of the pump to allow the liquid or fluid from the chamber to flow in, and the outlet at the top portion of the unit may be connected to a channel to allow the liquid or fluid to be pumped into another chamber through this channel. For a receiving matrix unit, the inlet at the bottom portion of the pump may be connected to a channel to allow the liquid to be sucked in through this channel. The outlet of the pump may be connected to the top portion of the chamber to allow the fluid or liquid to be pumped into the chamber. For a self-circulation matrix unit, both the inlet and the outlet of the pump may be connected to the same chamber; the liquid or fluid may be circulated through the pump and the chamber for mixing purposes. The self-circulating matrix unit may include additional openings at the self-circulation chamber to allow different liquids or fluids to be pumped in or sucked out.

The units may be arranged in a (m×n) matrix based on the application, where "in" may be any positive integer, and "n" may be any positive integer. Further, "in" and "n" may or may not be equal. The matrix units may be connected using the micro channels. The board may include a jumping channel layer to contain some channels, and a base channel layer to contain other channels to address overlapping issue.

The operation of the board may be programmable.

Various embodiments may have a matrix design for easy redesign. Various embodiments may include a base channel layer and a jumping channel layer to address overlapping issues. Various embodiments may have less liquid or fluid volume restriction. Various embodiments may be suitable for flexible programming.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A microfluidic board comprising:

a plurality of matrix units;

wherein each matrix unit of the plurality of matrix units is a stacked arrangement comprising:

a driving portion comprising an actuator;

a pump portion in contact with the driving portion, the pump portion comprising a pump;

a channel portion in contact with the pump portion, the channel portion comprising one or more channels; and a chamber portion in contact with the channel portion, the chamber portion comprising a chamber;

wherein the one or more channels are configured to direct fluid between the pump and the chamber;

wherein the actuator is configured to generate a force to drive the pump upon receiving of an input energy;

wherein the pump portions of the plurality of matrix units form a pump layer;

wherein the chamber portions of the plurality of matrix units form a chamber layer such that the chamber layer comprises a plurality of chambers;

wherein the channel portions of the plurality of matrix units form a channel layer;

wherein the channel layer is between the pump layer and the chamber layer;

wherein the channel layer comprises a base channel sub-layer and a jumping channel sub-layer;

wherein the pump layer, the chamber layer, the base channel sub-layer, and the jumping channel sub-layer are different layers;

wherein the base channel sub-layer comprises a first connecting channel connecting two chambers of the plurality of chambers of the chamber layer for fluid communication therebetween;

wherein at least one pump of the pump portions of the pump layer in fluid communication with one of the two chambers is capable of being driven to direct fluid flow between the two chambers;

wherein the jumping channel sub-layer comprises a second connecting channel connecting two other chambers of the plurality of the chambers of the chamber layer for fluid communication therebetween;

wherein at least one other pump of the pump portions of the pump layer in fluid communication with one of the two other chambers is capable of being driven to direct fluid flow between the two other chambers; and wherein the second connecting channel is overlapping with the first connecting channel.

2. The microfluidic board according to claim 1, wherein the driving portions of the plurality of matrix units form a driving layer.

3. The microfluidic board according to claim 1, wherein the plurality of matrix units is arranged in a regular array.

4. The microfluidic board according to claim 1, wherein at least one matrix unit of the plurality of matrix units is a delivering matrix unit;

wherein the pump of the delivering matrix unit has a cavity with an inlet and an outlet;

wherein a channel of the one or more channels of the delivering matrix unit is an inlet channel connecting the chamber of the delivering matrix unit and the inlet of the pump of the delivering matrix unit;

wherein the delivering matrix unit further comprises an outlet channel connected to the outlet of the pump of the delivering matrix unit; and wherein the actuator of the driving portion of the delivering matrix unit and the cavity of the pump of the delivering matrix unit define an enclosed space so that the enclosed space is increased when the actuator moves in a first direction to direct the fluid into the cavity of the pump of the delivering matrix unit, and the enclosed space is decreased when the actuator moves in a second direction to direct the fluid out of the cavity of the pump of the delivering matrix unit.

5. The microfluidic board according to claim 4, wherein the inlet of the pump of the delivering matrix unit comprises a first valve configured to allow flow of the fluid to the cavity of the pump of the delivering matrix unit;

wherein the outlet of the pump of the delivering matrix unit comprises a second valve configured to allow flow of the fluid out of the cavity of the pump of the delivering matrix unit.

6. The microfluidic board according to claim 5,
wherein the first valve and the second valve are check valves configured to allow flow of the fluid in only one direction.

7. The microfluidic board according to claim 4,
wherein the outlet channel is configured to direct the fluid out from the delivering matrix unit.

8. The microfluidic board according to claim 1,
wherein at least one matrix unit of the plurality of matrix units is a receiving matrix unit;
wherein the pump of the receiving matrix unit has a cavity with an inlet and an outlet;
wherein a channel of the one or more channels of the receiving matrix unit is an outlet channel connecting the chamber of the receiving matrix unit and the outlet of the pump of the receiving matrix unit;
wherein the receiving matrix unit further comprises an inlet channel connected to the inlet of the pump of the receiving matrix unit;
and
wherein the actuator of the driving portion of the receiving matrix unit and the cavity of the pump of the receiving matrix unit define an enclosed space so that the enclosed space is increased when the actuator moves in a first direction to direct the fluid into the cavity, and the enclosed space is decreased when the actuator moves in a second direction to direct the fluid out of the cavity.

9. The microfluidic board according to claim 8,
wherein the inlet channel is configured to direct the fluid to the receiving matrix unit.

10. The microfluidic board according to claim 1,
wherein at least one matrix unit of the plurality of matrix units is a self-circulation matrix unit;
wherein the pump of the self-circulation matrix unit has a cavity with an inlet and an outlet;
wherein a first channel of a plurality of channels of the self-circulation matrix unit is an inlet channel connecting the chamber of the self-circulation matrix unit and the inlet of the pump of the self-circulation matrix unit;
wherein a second channel of the plurality of channels of the self-circulation matrix unit is an outlet channel connecting the chamber of the self-circulation matrix unit and the outlet of the pump of the self-circulation matrix unit; and
wherein the actuator of the driving portion of the self-circulation matrix unit and the cavity of the pump of the self-circulation matrix unit define an enclosed space so that the enclosed space is increased when the actuator moves in a first direction to direct the fluid into the cavity, and the enclosed space is decreased when the actuator moves in a second direction to direct the fluid out of the cavity.

11. The microfluidic board according to claim 10,
wherein the self-circulation matrix unit further comprises one or more incoming connection channels configured to direct the fluid from another matrix unit of the plurality of matrix units to the self-circulation matrix unit; and
wherein the self-circulation matrix unit further comprises one or more outgoing connection channels configured to direct the fluid from the self-circulation matrix unit to yet another matrix unit of the plurality of matrix units.

12. The microfluidic board according to claim 1, further comprising:
a controller in electrical connection with the plurality of matrix units.

13. The microfluidic board according to claim 12,
wherein the controller is configured so that two or more matrix units of the plurality of matrix units are in operation simultaneously.

14. The microfluidic board according to claim 12,
wherein the controller is configured so that the plurality of matrix units is in operation in a sequential manner.

15. The microfluidic board according to claim 1, further comprising:
a filter configured to trap particles above a predetermined size from the fluid.

16. A method of forming a microfluidic board, the method comprising:
forming a plurality of matrix units;
wherein each matrix unit of the plurality of matrix units is a stacked arrangement comprising:
a driving portion comprising an actuator;
a pump portion in contact with the driving portion, the pump portion comprising a pump;
a channel portion in contact with the pump portion, the channel portion comprising one or more channels; and
a chamber portion in contact with the channel portion, the chamber portion comprising a chamber;
wherein the one or more channels are configured to direct fluid between the pump and the chamber;
wherein the actuator is configured to generate a force to drive the pump upon receiving of an input energy;
wherein the pump portions of the plurality of matrix units form a pump layer;
wherein the chamber portions of the plurality of matrix units form a chamber layer such that the chamber layer comprises a plurality of chambers;
wherein the channel portions of the plurality of matrix units form a channel layer;
wherein the channel layer is between the pump layer and the chamber layer;
wherein the channel layer comprises a base channel sub-layer and a jumping channel sub-layer;
wherein the pump layer, the chamber layer, the base channel sub-layer, and the jumping channel sub-layer are different layers;
wherein the base channel sub-layer comprises a first connecting channel connecting any two chambers of the plurality of chambers of the chamber layer for fluid communication therebetween;
wherein at least one pump of the pump portions of the pump layer in fluid communication with one of the two chambers is capable of being driven to direct fluid flow between the two chambers;
wherein the jumping channel sub-layer comprises a second connecting channel connecting any two other chambers of the plurality of chambers of the chamber layer for fluid communication therebetween;
wherein at least one other pump of the pump portions of the pump layer in fluid communication with one of the two other chambers is capable of being driven to direct fluid flow between the two other chambers; and
wherein the second connecting channel is overlapping with the first connecting channel.

17. The method according to claim 16,
wherein the driving portions of the plurality of matrix units form a driving layer.

18. The method according to claim 17, wherein the pump layer is formed on the driving layer;

wherein the channel layer is formed on the pump layer; and wherein the chamber layer is formed on the channel layer.

19. The method according to claim 16, wherein the matrix units are arranged in a regular array.

20. The method according to claim 16, wherein at least one matrix unit of the plurality of matrix units is a delivering matrix unit;

wherein the pump of the delivering matrix unit has a cavity with an inlet and an outlet;

wherein a channel of the one or more channels of the delivering matrix unit is an inlet channel connecting the chamber of the delivering matrix unit and the inlet of the pump of the delivering matrix unit;

wherein the delivering matrix unit further comprises an outlet channel connected to the outlet of the pump of the delivering matrix unit; and wherein the actuator of the driving portion of the delivering matrix unit and the cavity of the pump of the delivering matrix unit define an enclosed space so that the enclosed space is increased when the actuator moves in a first direction to direct the fluid into the cavity of the pump of the delivering matrix unit, and the enclosed space is decreased when the actuator moves in a second direction to direct the fluid out of the cavity of the pump of the delivering matrix unit.

* * * * *